US009278523B2

(12) United States Patent
Kayahara et al.

(10) Patent No.: US 9,278,523 B2
(45) Date of Patent: Mar. 8, 2016

(54) DOT RECORDING APPARATUS, DOT RECORDING METHOD AND COMPUTER PROGRAM FOR THE SAME

(71) Applicant: SEIKO EPSON CORPORATION, Tokyo (JP)

(72) Inventors: Naoki Kayahara, Chino (JP); Tomohiro Yuda, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/328,917

(22) Filed: Jul. 11, 2014

(65) Prior Publication Data

US 2015/0015626 A1 Jan. 15, 2015

(30) Foreign Application Priority Data

Jul. 12, 2013 (JP) ..... 2013-147020

(51) Int. Cl.
*B41J 2/205* (2006.01)
*B41J 2/07* (2006.01)
*B41J 2/21* (2006.01)

(52) U.S. Cl.
CPC . *B41J 2/07* (2013.01); *B41J 2/2132* (2013.01)

(58) Field of Classification Search
USPC ..... 347/9, 12, 15, 41, 42
See application file for complete search history.

(56) References Cited

U.S. PATENT DOCUMENTS 5,633,663 A 5/1997 Matsubara et al.
5,992,962 A * 11/1999 Yen et al. ..... 347/9
8,786,896 B2 * 7/2014 Marumoto et al. ..... 358/1.2
2007/0236745 A1 10/2007 Noguchi et al.
2008/0079960 A1 4/2008 Yamazaki
2009/0091785 A1 4/2009 Yokouchi et al.
2010/0110131 A1 5/2010 Nashimoto
2011/0261100 A1 10/2011 Miyashita et al.

FOREIGN PATENT DOCUMENTS

| | | |
|---|---|---|
| EP | 1216154 | 7/2006 |
| JP | 06-022106 | 1/1994 |
| JP | 2007-268825 | 10/2007 |
| JP | 2007-306550 | 11/2007 |
| JP | 2008-030205 | 2/2008 |
| JP | 2008-030206 | 2/2008 |
| JP | 2008-030207 | 2/2008 |
| JP | 2008-230082 | 10/2008 |
| JP | 2009-051063 | 3/2009 |
| WO | 01/19616 | 3/2001 |

OTHER PUBLICATIONS

European Search Report for Application No. 14176800.2 dated Nov. 25, 2015.

* cited by examiner

*Primary Examiner* — Hai C Pham
(74) *Attorney, Agent, or Firm* — Workman Nydegger

(57) ABSTRACT

Multi-pass recording is executed for each of n types of super cell regions that are each defined as a region that contains pixel positions in which recording of dots is performed in various types of main scan passes of n types of main scan passes. The n types of super cell regions (i) include a boundary portion that is not parallel to either a main scanning direction or a sub-scanning direction in at least a portion of a boundary of the individual super cell regions, and (ii) are arranged such that the boundary of the n types of super cell regions appears periodically repeating along both the main scanning direction and the sub-scanning direction.

10 Claims, 30 Drawing Sheets

●: EXECUTE RECORDING IN ODD PASSES
○: EXECUTE RECORDING IN EVEN PASSES

SC1: EXECUTE RECORDING IN 3q+1-TH PASS
SC2: EXECUTE RECORDING IN 3q+2-TH PASS
SC3: EXECUTE RECORDING IN 3q+3-TH PASS
(WHERE q IS INTEGER OF 0 OR GREATER)

SC1: EXECUTE RECORDING IN 4q+1-TH PASS
SC2: EXECUTE RECORDING IN 4q+2-TH PASS
SC3: EXECUTE RECORDING IN 4q+3-TH PASS
SC4: EXECUTE RECORDING IN 4q+4-TH PASS

SC1: EXECUTE RECORDING IN 6q+1-TH PASS
SC2: EXECUTE RECORDING IN 6q+2-TH PASS
SC3: EXECUTE RECORDING IN 6q+3-TH PASS
SC4: EXECUTE RECORDING IN 6q+4-TH PASS
SC5: EXECUTE RECORDING IN 6q+5-TH PASS
SC6: EXECUTE RECORDING IN 6q+6-TH PASS

DOT RECORDING APPARATUS, DOT RECORDING METHOD AND COMPUTER PROGRAM FOR THE SAME

BACKGROUND

1. Technical Field

The present invention relates to a dot recording apparatus, a dot recording method and a computer program for the same.

2. Related Art

A printing apparatus that causes a plurality of recording heads, which discharge inks of different colors, to move reciprocally in relation to a recording material and performs printing by performing a main scan during the outward movement and during the return movement is known as the dot recording apparatus (for example, JP-A-6-22106). In the printing apparatus, pixel groups that are configured of m×n pixels are arranged so as not to be adjacent to one another within a region in which it is possible to print in one main scan. The recording is completed by performing the main scan multiple times using multiple interleaving patterns that are in an inter-complementary arrangement relationship.

However, in the printing apparatus of the related art described above, since the individual pixel groups have rectangular shapes, and the boundaries thereof are configured of sides that are parallel to the main scanning direction and sides that are parallel to the sub-scanning direction, a long boundary that extends in the main scanning direction and a long boundary that extends in the sub-scanning direction are formed due to the convergence of the boundaries of adjacent pixel groups. Therefore, there are problems in that banding (regions of image quality degradation) occurs easily along the long boundaries and easily becomes conspicuous. These problems are not limited to a printing apparatus, and are common problems in dot recording apparatuses that record dots on a recording medium (a dot recording medium).

SUMMARY

The invention can be realized in the following forms or application examples.

(1) According to an aspect of the invention, there is provided a dot recording apparatus. The dot recording apparatus includes a recording head that includes a plurality of nozzles; a main scan drive mechanism that executes a main scan pass for forming dots on a recording medium while causing the recording head and the recording medium to move relative to one another in a main scanning direction; a sub-scan drive mechanism that executes a sub-scan for causing the recording medium and the recording head to move relative to one another in a sub-scanning direction that intersects the main scanning direction; and a control unit. The control unit executes multi-pass recording in which recording of dots on a main scan line is completed in n (where n is a predetermined integer of 2 or greater) main scan passes, and executes the multi-pass recording for each of n types of super cell regions that are each defined as regions that contain pixel positions in which recording of dots is performed in each main scan pass. The n types of super cell regions (i) include a boundary portion that is not parallel to either the main scanning direction or the sub-scanning direction in at least a portion of a boundary of the individual super cell regions, and (ii) are arranged such that the boundary of the n types of super cell regions appears periodically repeating along both the main scanning direction and the sub-scanning direction. According to the dot recording apparatus of this aspect, at least a portion of the boundary of the individual super cell regions includes a boundary portion that is not parallel to either the main scanning direction or the sub-scanning direction; thus, the banding may be rendered less conspicuous in comparison to a case in which the boundary is configured of only a boundary that is parallel to the main scanning direction and a boundary that is parallel to the sub-scanning direction.

(2) In the dot recording apparatus of the aspect described above, the super cell regions may be defined as regions in which an order of main scan passes in the multi-pass recording is represented by an ordinal number (n×q+k) that is calculated using a parameter k (where k is an integer that changes between 1 and n in a cyclic manner) and a parameter q (where q is an integer that increases by 1 at a time from 0), and, when a plurality of main scan passes are classified into n types of main scan passes using n types of ordinal numbers (n×q+k) that correspond to different values of the parameter k, the regions may contain pixel positions in which recording of dots is performed in each type of main scan pass of the n types of main scan passes. According to the dot recording apparatus of this aspect, the super cell region can be easily defined.

(3) In the dot recording apparatus of the aspect described above, at least one of the super cell regions of the n types of super cell regions may have a repeating pattern shape of a single polygonal shape. According to the dot recording apparatus of this aspect, the magnitude of memory for defining the super cell regions can be reduced.

(4) In the dot recording apparatus of the aspect described above, first super cell regions and second super cell regions of the n types of super cell regions may overlap one another. According to the dot recording apparatus of this aspect, since two of the super cell regions overlap one another, the banding can be rendered less conspicuous.

(5) In the dot recording apparatus of the aspect described above, in an intermediate region in which the first super cell regions and the second super cell regions overlap one another, a dot recording charge rate, which is a ratio of the number of pixel positions at which dot recording is executed as pixel positions that belong to the first super cell regions to the number of pixel positions at which dot recording is executed as pixel positions that belong to the second super cell regions, may be set to change as progress is made from the first super cell regions toward the second super cell regions. According to the dot recording apparatus of this aspect, since gradation of the dot recording charge rate is formed in the intermediate region at which the overlapping occurs, the banding can be rendered yet less conspicuous.

(6) In the dot recording apparatus of this aspect, when a boundary of one of the individual super cell regions contains a portion that is parallel to one of the main scanning direction and the sub-scanning direction, the parallel portion may appear intermittently on the recording medium without continuing. According to the dot recording apparatus of this aspect, since the boundary that is parallel to the main scanning direction or the sub-scanning direction appears intermittently, the banding can be rendered less conspicuous.

(7) In the dot recording apparatus of this aspect, a boundary of first super cell regions of the n types of super cell regions may be shifted in the main scanning direction or the sub-scanning direction so as not to overlap the boundary of other super cell regions. According to the dot recording apparatus of this aspect, since the boundaries of each of the super cell regions do not overlap one another, the banding can be rendered yet less conspicuous.

(8) In the dot recording apparatus of this aspect, the n types of super cell regions may have different shapes from one another. According to the dot recording apparatus of this aspect, the boundaries of the n types of the super cell regions do not easily overlap one another, and the banding can be rendered yet less conspicuous.

The invention can be realized using various embodiments. For example, in addition to a dot recording apparatus, the invention can be realized using various embodiments such as a dot recording method, a computer program that creates raster data for executing the dot recording, and a storage medium storing the computer program that creates raster data for executing the dot recording.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
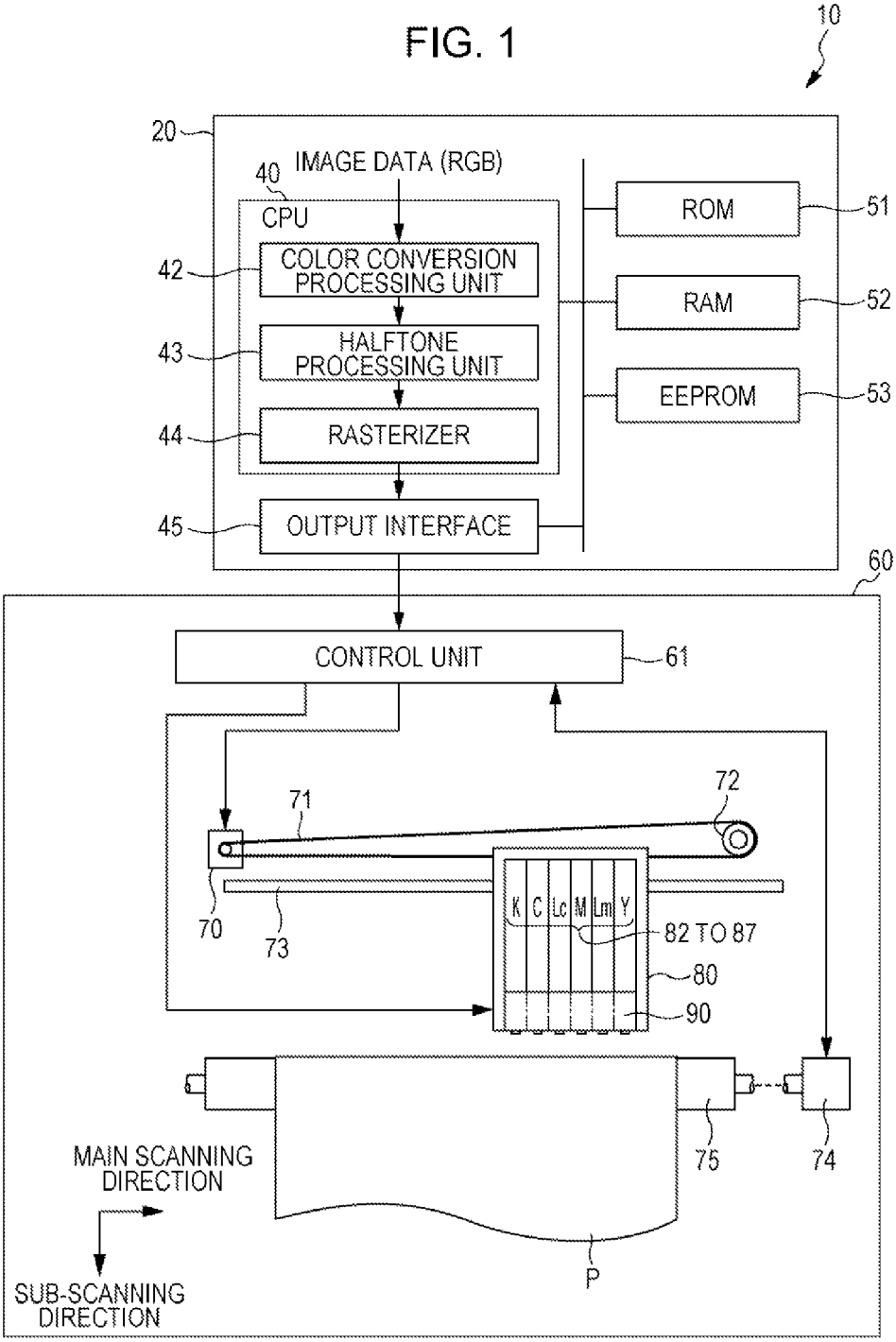
FIG. 1 is an explanatory diagram showing the configuration of a dot recording system.

FIG. 1 is an explanatory diagram showing the configuration of a dot recording system. A dot recording system 10 is provided with an image processing unit 20 and a dot recording unit 60. The image processing unit 20 generates print data for the dot recording unit 60 from image data (for example, RGB image data).

The image processing unit is provided with a CPU 40 (also referred to as the "control unit 40"), ROM 51, RAM 52, EEPROM 53 and an output interface 45. The CPU 40 includes the functions of a color conversion processing unit 42, a halftone processing unit 43 and a rasterizer 44. These functions are realized using a computer program. The color conversion processing unit 42 converts multi-gradation RGB data of an image into ink amount data that indicates the ink amounts of a plurality of colors of ink. The halftone processing unit 43 creates dot data that indicates the dot formation state for each pixel by executing a halftone process in relation to the ink amount data. The rasterizer 44 rearranges the dot data that is generated by the halftone process into dot data that is used in each main scan by the dot recording unit 60. Hereinafter, the dot data for each main scan that is generated by the rasterizer 44 will be referred to as "raster data". The operations of the dot recording described in the various embodiments hereinafter are the rasterization operations that are realized by the rasterizer 44 (that is, the operations that are represented by the raster data).

The dot recording unit 60 is, for example, a serial-type ink jet recording apparatus and is provided with a control unit 61, a carriage motor 70, a drive belt 71, a pulley 72, a sliding shaft 73, a feed motor 74, a feed roller 75, a carriage 80, ink cartridges 82 to 87 and recording heads 90.

The drive belt 71 is attached tautly between the carriage motor 70 and the pulley 72. The carriage 80 is attached to the drive belt 71. The ink cartridges 82 to 87, each of which holds a cyan ink (C), a magenta ink (M), a yellow ink (Y), a black ink (K), a light cyan ink (Lc) or a light magenta ink (Lm), are mounted in the carriage 80. Furthermore, it is possible to use various inks other than those exemplified here. Nozzle rows that correspond to each color of ink described above are formed on the recording heads 90 of the bottom portion of the carriage 80. When the ink cartridges 82 to 87 are mounted in the carriage 80 from above, it is possible to supply the ink from each of the cartridges to the recording heads 90. The sliding shaft 73 is arranged parallel to the drive belt 71 and passes through the carriage 80.

When the carriage motor 70 drives the drive belt 71, the carriage 80 moves along the sliding shaft 73. The direction thereof is referred to as the "main scanning direction". The carriage motor 70, the drive belt 71 and the sliding shaft 73 configure a main scan drive mechanism. The ink cartridges 82 to 87 and the recording head 90 also move in the main scanning direction together with the movement of the carriage 80 in the main scanning direction. The dot recording to a recording medium P is executed by the ink being discharged from the nozzles (described hereinafter) that are arranged on the recording head 90 onto the recording medium P (typically printing paper) during the movement in the main scanning direction. Thus, the movement in the main scanning direction and the discharging of the ink of the recording head 90 is referred to as the main scan, and one main scan is referred to as a "main scan pass" or simply as a "pass".

The feed roller 75 is connected to the feed motor 74. The recording medium P is inserted on the feed roller 75 during the recording. When the carriage 80 moves to the end portion in the main scanning direction, the control unit 61 causes the feed motor 74 to rotate. Accordingly, the feed roller 75 also rotates and causes the recording medium P to move. The direction of relative movement between the recording medium P and the recording head 90 is referred to as the "sub-scanning direction". The feed motor 74 and the feed roller 75 configure the sub-scan drive mechanism. The sub-scanning direction is a direction that is perpendicular to (a direction that intersects) the main scanning direction. However, the sub-scanning direction and the main scanning direction do not necessarily have to be perpendicular to one another. It is sufficient that the main scanning direction and the sub-scanning direction intersect one another. Note that, the main scan operation and the sub-scan operation are normally executed alternately. For the dot recording operation, it is possible to execute at least one of a mono-directional recording operation in which the dot recording is executed only in the outward main scan and a bi-directional recording operation in which the dot recording is executed in both the outward and the return main scans. The outward main scan and the return main scan simply refer to opposing directions in the main scanning direction; thus, description will be given hereinafter without distinguishing the outward and the return, unless particularly necessary.

The image processing unit 20 may be configured integrally with the dot recording unit 60. The image processing unit 20 may be stored in a computer (not shown) and configured separately from the dot recording unit 60. In this case, the image processing unit 20 may be executed by a CPU as printer driver software on a computer (a computer program).

Figure 2:
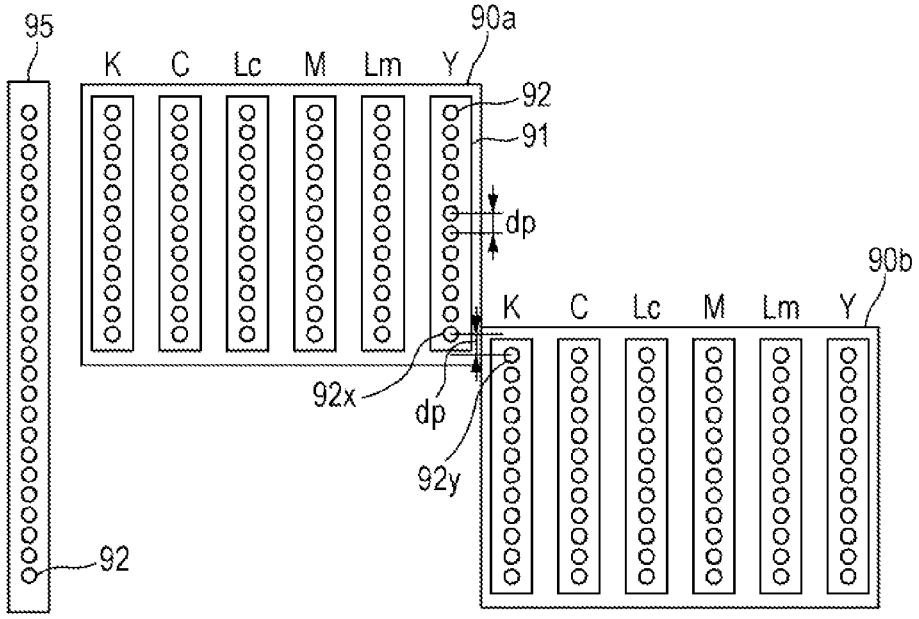
FIG. 2 is an explanatory diagram showing an example of the configuration of nozzle rows of recording heads.

FIG. 2 is an explanatory diagram showing an example of the configuration of the nozzle rows of the recording heads 90. In FIG. 2, two of the recording heads 90 are shown. However, there may be one, or, two or more of the recording heads 90. Two recording heads 90*a* and 90*b* are respectively provided with a nozzle row 91 for each color. Each of the nozzle rows 91 is provided with a plurality of nozzles 92 that are lined up in the sub-scanning direction at a fixed nozzle pitch dp. A nozzle 92*x* of the end portion of the nozzle row 91 of the first recording head 90*a* and a nozzle 92*y* of the end portion of the nozzle row 91 of the second recording head 90*b* are offset from one another in the sub-scanning direction by the same magnitude as the nozzle pitch dp in the nozzle rows 91. In this case, the nozzle rows used for one color of the two recording heads 90*a* and 90*b* are equivalent to a nozzle row 95 (shown on the left side of FIG. 2) that has twice the number of nozzles for one color of one of the recording heads 90. The description hereinafter will be given of a method of performing the dot recording for one color using the equivalent nozzle row 95. Furthermore, in the first embodiment, the nozzle pitch dp and the pixel pitch on the recording medium P are equal. However, it is possible to set the nozzle pitch dp to be an integer multiple of the pitch of the pixels on the recording medium P. In the latter case, so-called interlaced recording (an operation in which an operation of recording the dots in the second pass onward so as to fill gaps in the dots between the main scan lines that are recorded in the first pass is executed) is executed. The nozzle pitch dp is, for example, a value equivalent to 720 dpi (0.035 mm).

Figure 3:
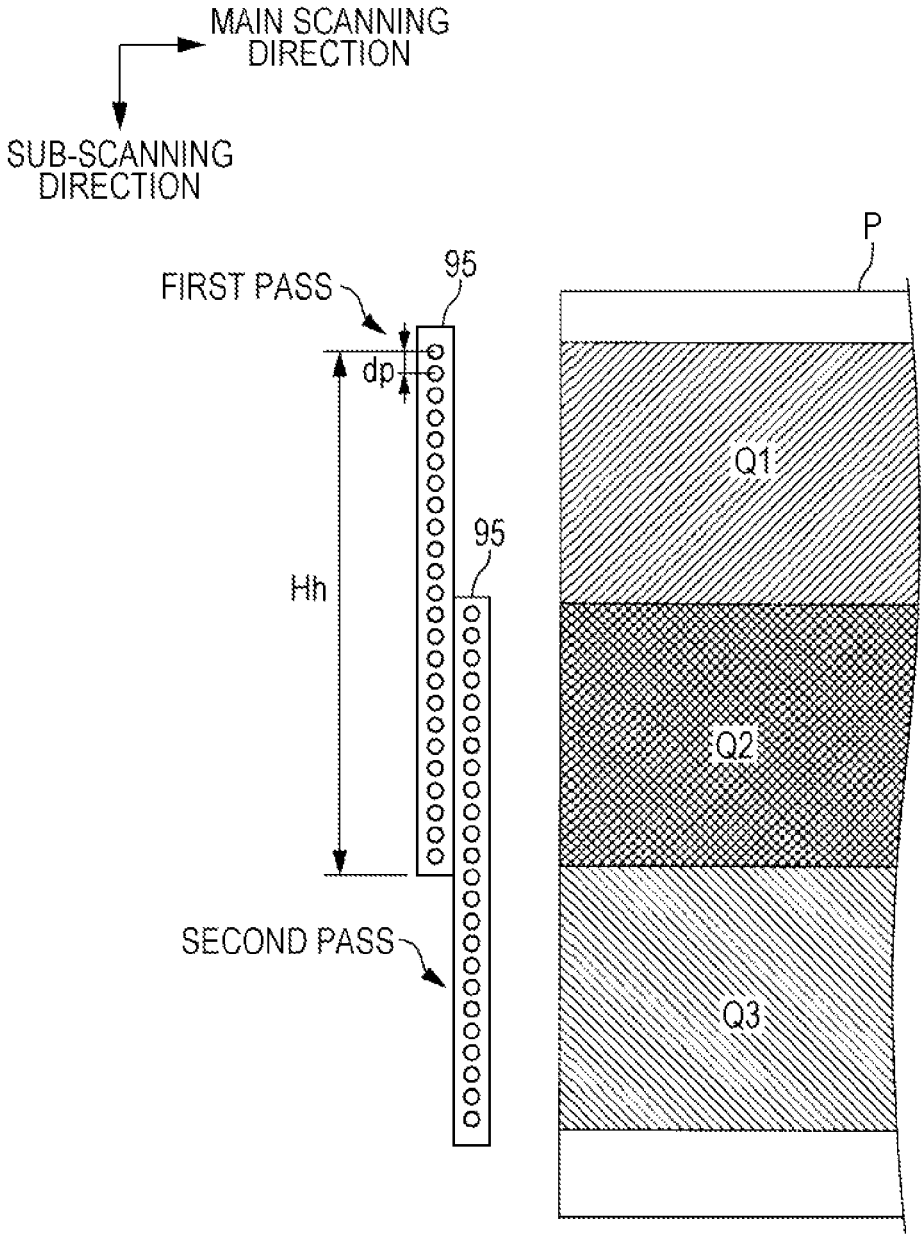
FIG. 3 is an explanatory diagram showing, in relation to a first embodiment, the positions of the nozzle row in two main scan passes of the dot recording, and recording regions in relation to the positions.

FIG. 3 is an explanatory diagram showing, in relation to the first embodiment, the positions of the nozzle row 95 in two main scan passes of the dot recording, and the recording regions in relation to the positions. The description hereinafter will be given exemplifying a case in which dots are formed on all the pixels of the recording medium P using one color of ink (for example, a cyan ink). In this specification, a dot recording operation in which the formation of dots on the individual main scan lines is completed in N (where N is an integer of 2 or higher) main scan passes is referred to as "multi-pass recording". In this embodiment, the number of passes N of the multi-pass recording is 2. The position of the nozzle row 95 between the first pass (1P) and the second pass (2P) is offset in the sub-scanning direction by a distance that is equivalent to half of a head height Hh. Here, the "head height Hh" refers to the distance represented by M×dp (where M is the number of nozzles of the nozzle row 95 and dp is the nozzle pitch).

In the first pass, the dot recording is executed within the recording medium P in relation to 50% of all the pixels of a region Q1 and 50% of all the pixels of a region Q2. The region Q1 is configured of the main scan line that the nozzles of the upper half of the nozzle row 95 pass over, and the region Q2 is configured of the main scan line that the nozzles of the lower half of the nozzle row 95 pass over. In the second pass, the dot recording is executed within the recording medium P in relation to the remaining 50% of all the pixels of the region Q2 where dots are not formed in the first pass and 50% of all the pixels of a region Q3. The region Q2 is configured of the main scan line that the nozzles of the upper half of the nozzle row 95 pass over, and the region Q3 is configured of the main scan line that the nozzles of the lower half of the nozzle row 95 pass over. Therefore, the region Q2 is subjected to recording 50% at a time in each of the first and second passes; thus, the recording of 100% of the pixels is executed in total. Note that, in the third pass, the dot recording of the remaining 50% of the pixels of the region Q3 and 50% of the pixels of a subsequent region Q4 (not shown) is executed. Here, a case is anticipated in which an image (a solid image) that forms dots on all the pixels of the recording medium P is formed on the recording medium P. However, the recorded image (the printed image) that is represented by actual dot data contains pixels that actually form dots on the recording medium P and pixels that do not actually form dots on the recording medium P. In other words, whether or not to actually form dots on each pixel of the recording medium P is determined by the dot data that is generated by the half-tone process. In the present specification, the term "dot recording" means "executing the formation or non-formation of dots". In addition, the term "perform dot recording" is unrelated to whether or not dots are actually formed on the recording medium P, and the term is used to mean "to take charge of dot recording".

Figure 4:
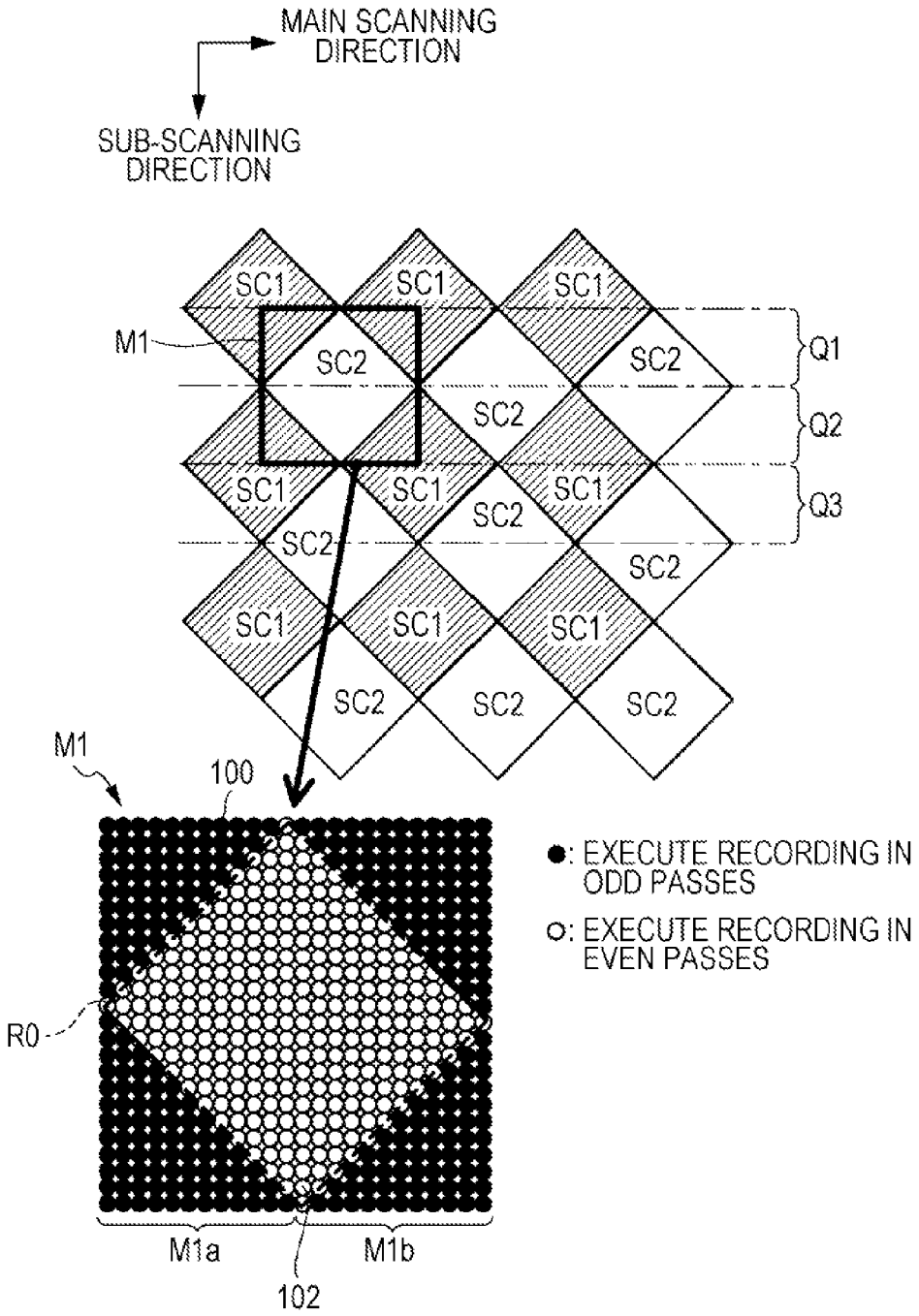
FIG. 4 is an explanatory diagram showing, in relation to the first embodiment, a dot recording pattern and a mask for creating the dot recording pattern.

FIG. 4 is an explanatory diagram showing, in relation to the first embodiment, a dot recording pattern and a mask for creating the dot recording pattern. The division of the three regions Q1, Q2 and Q3 that are denoted by the symbols on the right edge of FIG. 4 corresponds to the regions shown in FIG. 3. In this embodiment, in the first pass, the dot recording is executed in relation to the pixels of first super cell regions SC1 within the regions Q1 and Q2, and, in the second pass, the dot recording is executed in relation to the pixels of second super cell regions SC2 within the regions Q2 and Q3. The super cell regions SC1 and SC2 both have a rhombic shape. The first super cell regions SC1 are regions that contain the pixel positions at which the dot recording is performed in odd passes. The second super cell regions SC2 are regions that contain the pixel positions at which the dot recording is performed on even passes. The arrangement patterns of the two super cell regions SC1 and SC2 are repeatedly applied along the main scanning direction and the sub-scanning direction, respectively, on the recording medium P, and are cyclic. The two types of super cell regions SC1 and SC2 contact one another on the boundaries thereof, and there are no overlapping portions. The boundaries between the super cell regions SC1 and SC2 are not parallel to either the main scanning direction or the sub-scanning direction. Accordingly, banding that is parallel to the main scanning direction and banding that is parallel to the sub-scanning direction do not easily occur, and it is possible to render banding in the entire image less conspicuous. In this embodiment, the two super cell regions SC1 and SC2 have the same shape and the same magnitude. Note that the phrase "super cell region" means a region that is configured of multiple pixels.

The lower part of FIG. 4 shows an example of a mask M1 that can be used for forming the arrangement patterns of the super cell regions SC1 and SC2. The mask M1 contains the entirety of the second super cell region SC2 in the center thereof, and has a rectangular shape in which the four corners thereof contain regions of ¼ portions of the first super cell region SC1. In this embodiment, each of the masks M1 has a magnitude of 24 dots×24 dots. The number of pixels (24) in the sub-scanning direction of the mask M1 is equal to the number of the nozzles 92 of the nozzle row 95 in FIG. 2. Meanwhile, the number of pixels in the main scanning direction of the mask M1 is determined according to the shape and the magnitude of the repeating unit. For example, instead of one of the masks M1, two masks, masks M1*a*and M1*b*, that have a magnitude of 12 dots×24 dots may be used. In this case, the mask M1*b* is the same as the mask M1*a* that is subjected to a 180 degree rotation. Accordingly, it is possible to use only the mask M1*a*, and when the mask M1*a* is applied to the recording medium, the mask M1*a* is applied alternately in a state of being subjected to a 180 degree rotation. Alternatively, it is also possible to use a large mask in which an integer number of the masks M1 are lined up. As can be understood from the description, as the mask that sets whether or not each of the nozzles in each pass performs the dot recording, it is possible to use a mask of an arbitrary shape that realizes the arrangement patterns of the super cell regions SC1 and SC2 by the mask being repeatedly applied in the main scanning direction and the sub-scanning direction on the recording medium.

In regard to the mask M1, black circles 100 indicate the pixel positions in which the dot recording is performed in the first pass (the odd pass), and white circles 102 indicate the pixel positions in which the dot recording is performed in the second pass (the even pass) where the dot recording is not performed in the first pass (the odd pass). In the first pass, the dot recording is executed in the pixel positions of the black circles 100 of the mask M1 in relation to the regions Q1 and Q2, and, in the second pass, the dot recording is executed in the pixel positions of the white circles 102 of the mask M1 in relation to the regions Q2 and Q3. The first super cell regions SC1 indicated by the black circles 100 of the mask M1, and the second super cell regions SC2 indicated by the white circles 102 are complementary. In other words, on each main scan line, the dot recording is completed in two passes.

Figure 5:
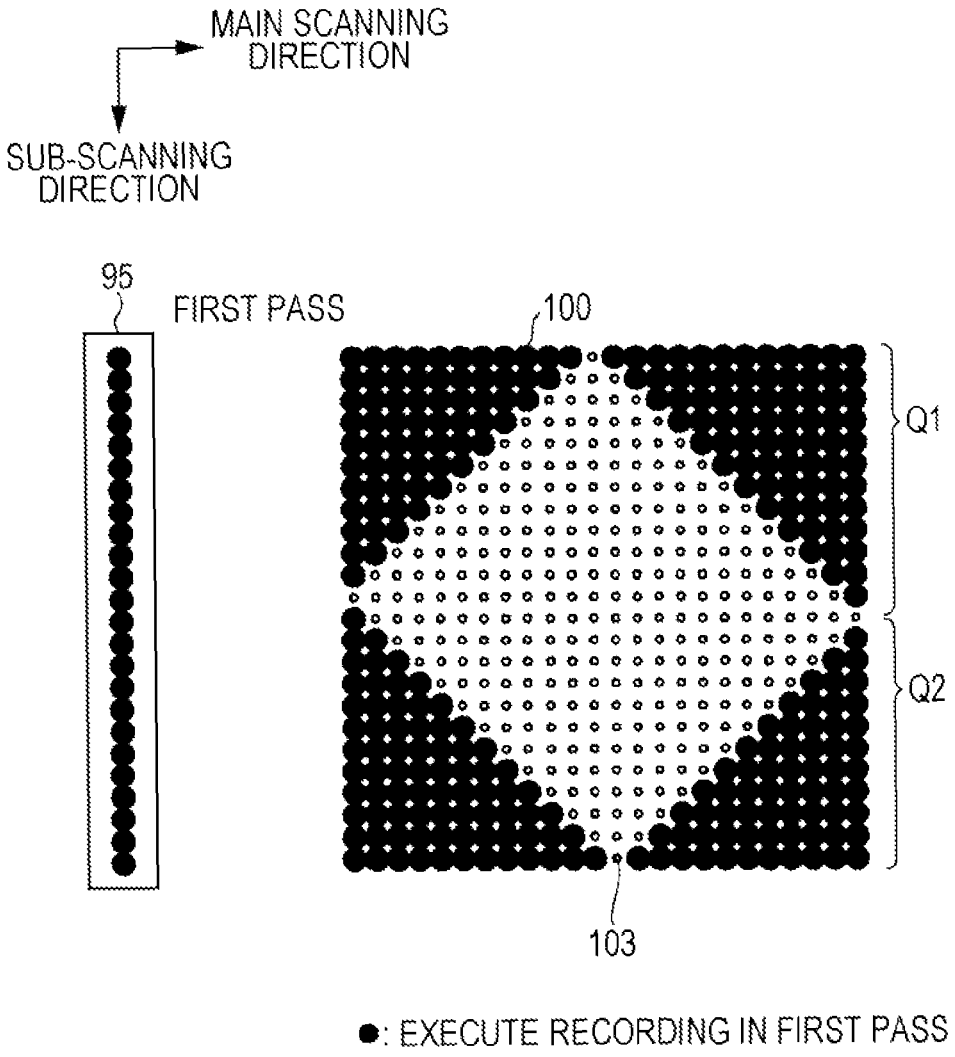
FIG. 5 is an explanatory diagram showing a state in which the dot recording is executed within two regions in a first pass.

FIG. 5 is an explanatory diagram showing a state in which the dot recording is executed within the regions Q1 and Q2 in the first pass. The nozzle row 95 is shown on the left side and the state of 24×24 pixels of the dot recording is shown on the right side. The actual regions Q1 and Q2 are regions that extend further lengthwise to the right side of FIG. 5. However, this is omitted for convenience of illustration. In the first pass, the dot recording is executed in relation to the first super cell regions SC1 (the regions indicated by the large black circles 100) within the regions Q1 and Q2, and the dot recording is not executed in relation to the second super cell regions SC2 (the regions indicated by the small white circles 103).

Figure 6:
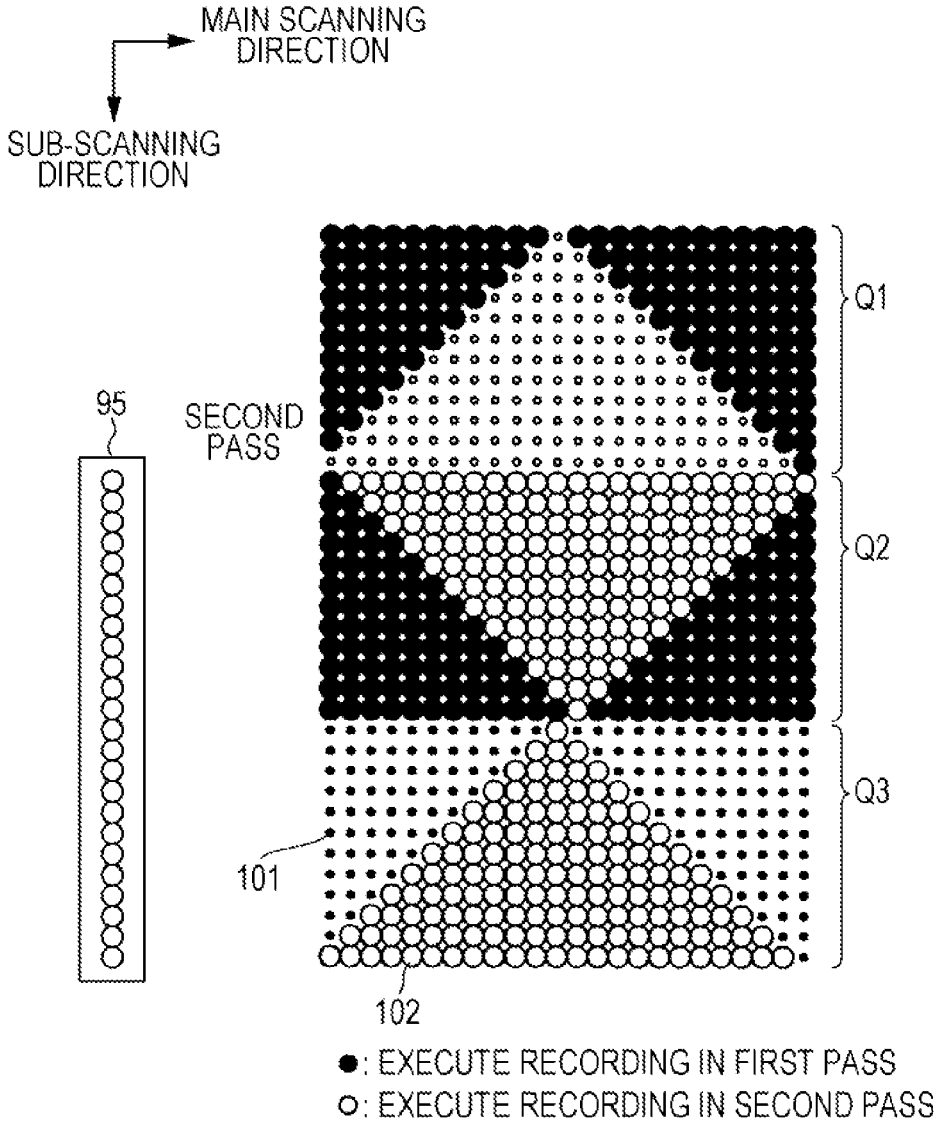
FIG. 6 is an explanatory diagram showing a state in which the dot recording is executed in a second pass.

FIG. 6 is an explanatory diagram showing the state in which the dot recording is executed in the second pass. In the second pass, the nozzle row 95 is shifted by 12 pixels in the sub-scanning direction, the dot recording is executed in relation to the second super cell regions SC2 (the regions indicated by the large white circles 102) within the regions Q2 and Q3, and the dot recording is not executed in relation to the first super cell regions SC1 (the regions indicated by the small black circles 101). As a result, the dot recording in relation to all the pixels of the region Q2 is completed. In the same manner, in regard to the third pass onward, in the odd pass, the dot recording is executed in relation to the pixel positions within the first super cell regions SC1, and, in the even pass, the dot recording is executed in relation to the pixel positions within the second super cell regions SC2. Therefore, all of the dot recording on the recording medium P is completed by executing the main scan passes and the sub-scans alternately multiple times in a repeated manner. In the upper region Q1, since the dot recording is not executed in relation to a portion of the pixel positions, the print-target regions in which the image is actually printed are the regions of the region Q2 and lower. This is also true of the other embodiments described hereinafter.

The dot recording operations described using FIGS. 3 to 6 are realized using a rasterization operation by the rasterizer 44. In other words, the dot recording operation is unrelated to the actual print-target image, and is an operation that determines with which nozzle and in which pass to execute the dot recording in relation to each pixel on each scan line. Whether or not a dot is actually formed is determined in relation to each pixel according to the print-target image. The mask M1 (FIG. 4) that is used in the rasterization operation is stored in a nonvolatile memory device such as the ROM 51 or the EEPROM 53.

In this embodiment, the boundaries of the two super cell regions SC1 and SC2 correspond to the boundaries between the pixel group in which the dot recording is performed in the first (odd) pass and the pixel group in which the dot recording is performed in the second (even) pass. In the first embodiment, since no portion of the boundaries is parallel to the main scanning direction or the sub-scanning direction, banding that is parallel to the main scanning direction or the sub-scanning direction does not occur easily.

The boundary of the super cell regions SC1 is a boundary portion that is parallel to a straight line that joins the central line of the pixels that are present on the outermost circumference of the super cell regions SC1 (the outermost circumferential pixels). It is preferable that the boundary of the super cell regions SC1 be configured of a boundary portion between the outermost circumferential pixels and the other pixels that are present outside thereof. The same is true for the other super cell regions SC2. In contrast, there are many cases in which the boundary between pixels is normally recognized as being formed in a lattice shape. When such a boundary between the pixels is used as the boundary of the super cell regions SC1 and SC2, the shape of the boundary becomes complex and instead, the shape of each of the super cell regions SC1 and SC2 becomes difficult to recognize. Therefore, it is preferable to use the definition described above for the boundary of the super cell regions SC1 and SC2.

As shown in FIG. 4, the super cell regions SC1 and SC2 appear periodically in a repeating manner. The periodic repetition can be easily realized by applying the mask M1 periodically. Here, it is possible to reduce the amount of memory used for the mask M1 by setting the magnitude of the mask M1 to be as small as possible. When the mask is applied repeatedly on the dot recording medium, one or more of the operations of a rotation in 90 degree units, a vertical flip and a horizontal flip may be performed on the entire mask. Additionally, reversal of the designation of executing or not executing the dot recording may be performed on each pixel position within the mask. This method of using the mask is applicable in the same manner to the other embodiments and modification examples that are described hereinafter.

Modification Example of First Embodiment

Figure 7A:
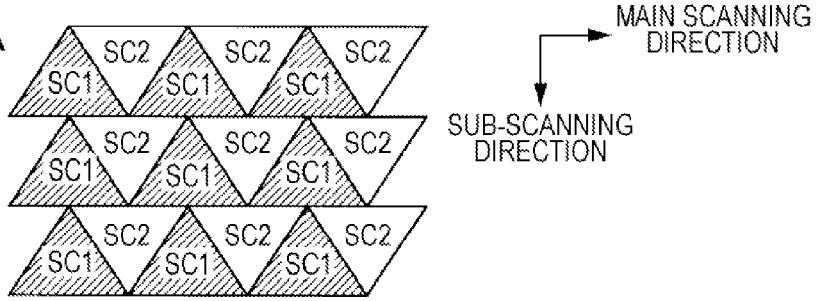
FIGS. 7A to 7C are explanatory diagrams showing variations of the super cell regions.
Figure 7B:
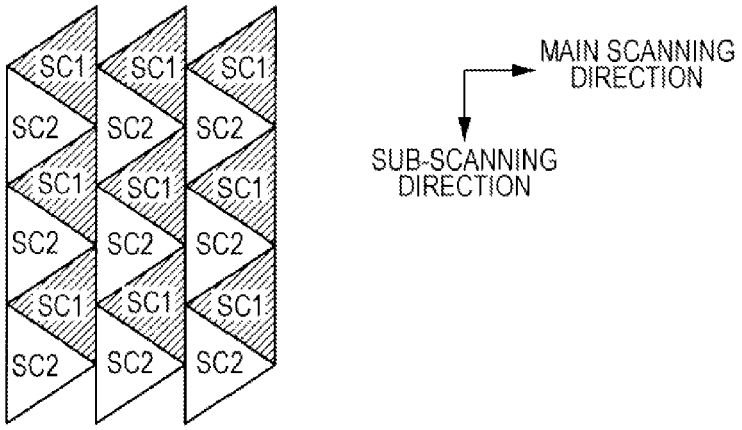
Figure 7C:
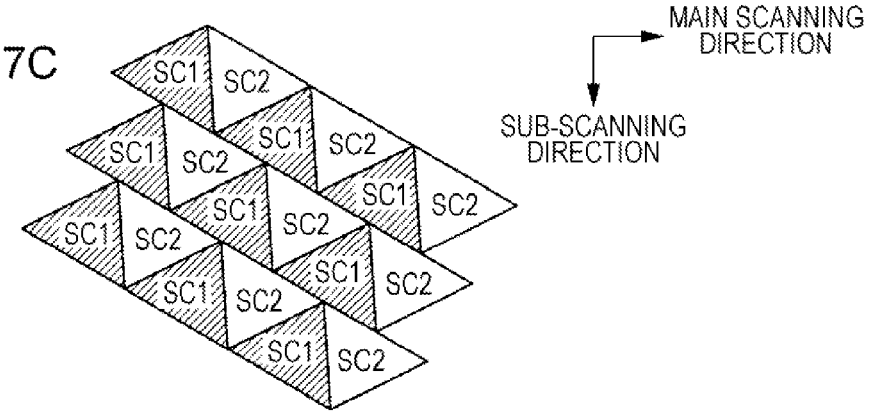

FIGS. 7A to 7C are explanatory diagrams showing variations of the super cell regions. In the pattern of FIG. 7A, the boundaries of the super cell regions SC1 and SC2 form triangles, and one side of the three sides of the triangle is parallel to the main scanning direction; however, the other two sides are not parallel to either the main scanning direction or the sub-scanning direction. In the pattern of FIG. 7B, the boundaries of the super cell regions SC1 and SC2 form triangles, and one side of the three sides of the triangle is parallel to the sub-scanning direction; however, the other two sides are not parallel to either the main scanning direction or the sub-scanning direction. The pattern of FIG. 7C is a pattern in which the boundaries of the super cell regions SC1 and SC2 form triangles, and the super cell regions SC1 and SC2 are subjected to rotation such that none of the three sides of the triangle are parallel to either the main scanning direction or the sub-scanning direction. In relation to the banding, of the three types of arrangement patterns of FIGS. 7A to 7C, the arrangement pattern of FIG. 7C is most preferable. This is because no portion of the boundary of the super cell regions SC1 and SC2 is parallel to the main scanning direction or the sub-scanning direction, and the banding is not conspicuous.

Figure 8A:
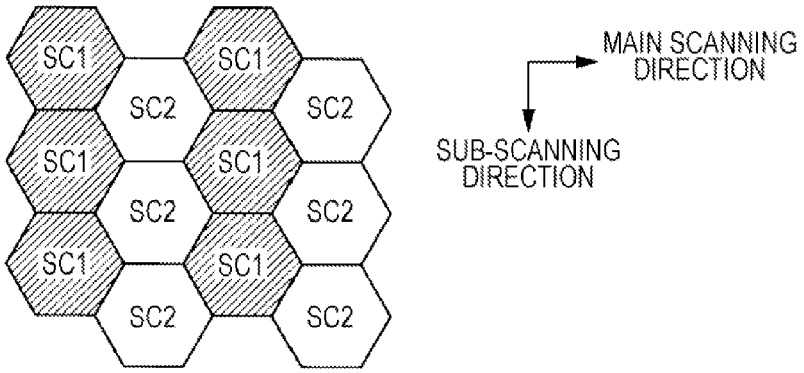
FIGS. 8A to 8C are explanatory diagrams showing other variations of the super cell regions.
Figure 8B:
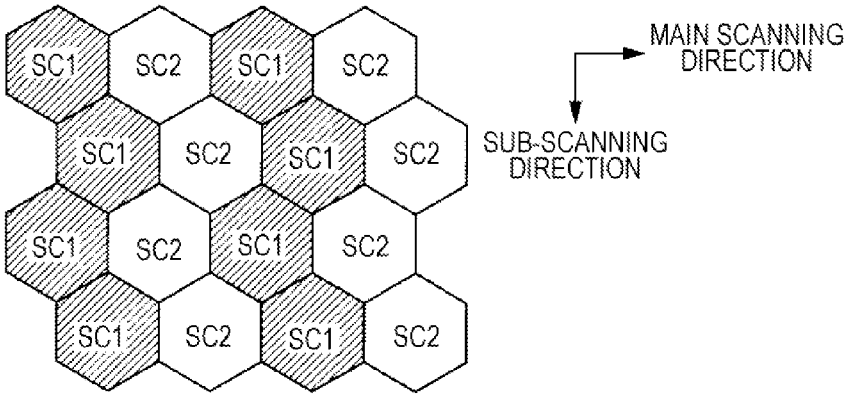
Figure 8C:
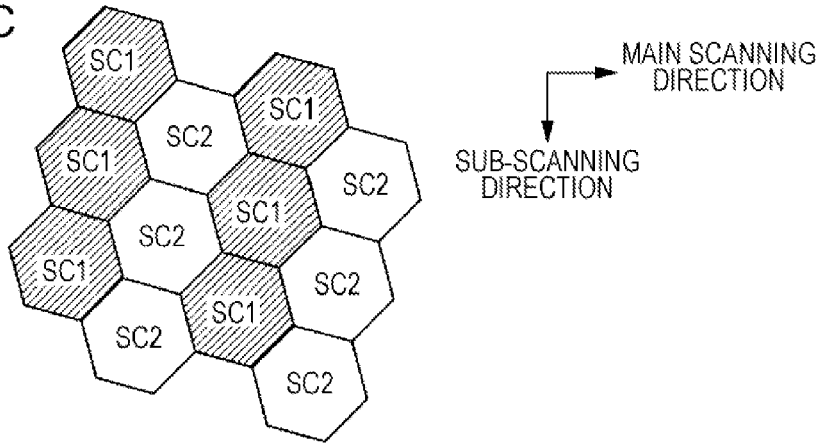

FIGS. 8A to 8C are explanatory diagrams showing other variations of the super cell regions. In the pattern of FIG. 8A, the boundaries of the super cell regions SC1 and SC2 form hexagons, and two sides of the six sides of the hexagon are parallel to the main scanning direction; however, the other four sides are not parallel to either the main scanning direction or the sub-scanning direction. In the pattern of FIG. 8B, the boundaries of the super cell regions SC1 and SC2 form hexagons, and two sides of the six sides of the hexagon are parallel to the sub-scanning direction; however, the other four sides are not parallel to either the main scanning direction or the sub-scanning direction. The pattern of FIG. 8C is a pattern in which the boundaries of the super cell regions SC1 and SC2 form hexagons, and the super cell regions SC1 and SC2 are subjected to rotation such that none of the six sides of the hexagon are parallel to either the main scanning direction or the sub-scanning direction. In this manner, the pattern may include, in at least a portion of the boundary of the individual super cell regions SC1 and SC2, a boundary portion that is not parallel to either the main scanning direction or the sub-scanning direction. However, in relation to the banding, of the three types of arrangement patterns of FIGS. 8A to 8C, the arrangement pattern of FIG. 8C is most preferable. This is because no portion of the boundary of the super cell regions SC1 and SC2 is parallel to the main scanning direction or the sub-scanning direction. Furthermore, the arrangement patterns of FIGS. 8A and 8B are preferable to the arrangement patterns of FIGS. 7A and 7B. This is because, in the arrangement patterns of FIGS. 8A and 8B, since the boundary portions that are parallel to the main scanning direction or the sub-scanning direction are configured not to form a continuous long straight line such as those of FIGS. 7A and 7B, and simply appear intermittently, the banding does not occur across a long distance and becomes less conspicuous.

Figure 9A:
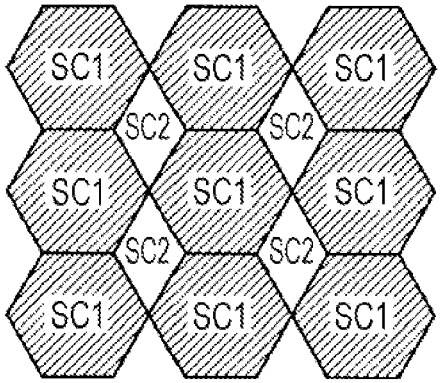
FIGS. 9A to 9C are explanatory diagrams showing yet more variations of the super cell regions.
Figure 9B:
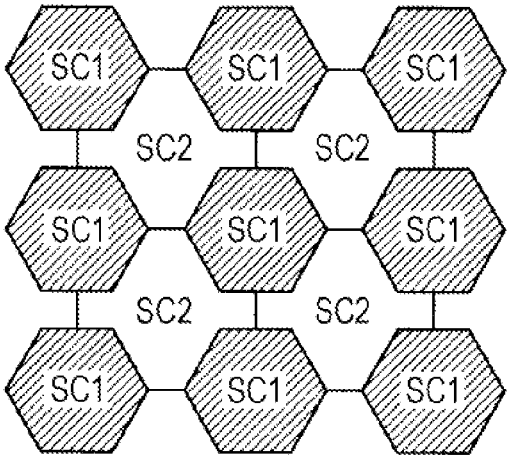
Figure 9C:
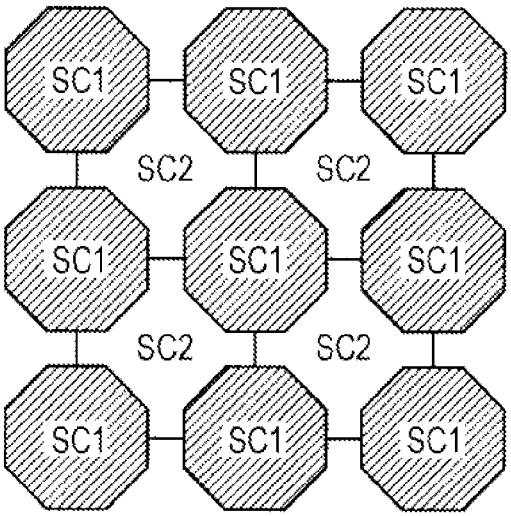

FIGS. 9A to 9C are explanatory diagrams showing yet more variations of the super cell regions. In the pattern of FIG. 9A, the first super cell regions SC1 are hexagonal and the second super cell regions SC2 are rhombic. In this manner, the two super cell regions SC1 and SC2 may have different shapes or magnitudes. In the pattern of FIG. 9B, the first super cell regions SC1 have a hexagonal shape (a convex polygonal shape); however, the second super cell regions SC2 have a concave polygonal shape. In the pattern of FIG. 9C, the first super cell regions SC1 have an octagonal shape (a convex polygonal shape); however, the second super cell regions SC2 have a concave polygonal shape. In FIGS. 9B and 9C, the second super cell regions SC2 are of a shape in which the first super cell region SC1 is subtracted from the entire region. Therefore, on one hand, the super cell regions SC1 have a repeating single polygonal shape (or a convex shape), and on the other hand, the super cell regions SC2 may have a shape in which the first super cell region SC1 is subtracted from the entire region, or a concave shape. The polygonal shape does not necessarily have to be a regular polygonal shape. As can be understood from FIGS. 9B and 9C, on one hand, the super cell regions SC2 may be formed as regions that continue across the entire recording medium. Since, in the cases of FIGS. 9B and 9C, the boundaries of the two super cell regions SC1 and SC2 appear periodically repeating in the main scanning direction and the sub-scanning direction, it can be understood that this is common to the other arrangement patterns also. The three types of arrangement patterns of FIGS. 9A to 9C are preferable in that the boundary portions that are parallel to the main scanning direction or the sub-scanning direction are not configured to form a continuous long straight line as in FIGS. 7A and 7B and appear intermittently. The shapes of the super cell regions shown in FIGS. 7A to 9C may be used in each of the embodiments described hereinafter.

In the first embodiment, description is given with the number of the nozzles 92 of the nozzle row 95 set to 24, the magnitude in the sub-scanning direction of the mask M1 is set to the same number, 24 dots. However, the magnitude in the sub-scanning direction of the mask M1 may be 1/the integer number of nozzles 92 of the nozzle row 95. Even if this configuration is adopted, the two super cell regions SC1 and SC2 can appear periodically repeating in the main scanning direction and the sub-scanning direction. This is also true of the embodiments of the second embodiment onward that are described below.

Second Embodiment

Figure 10:
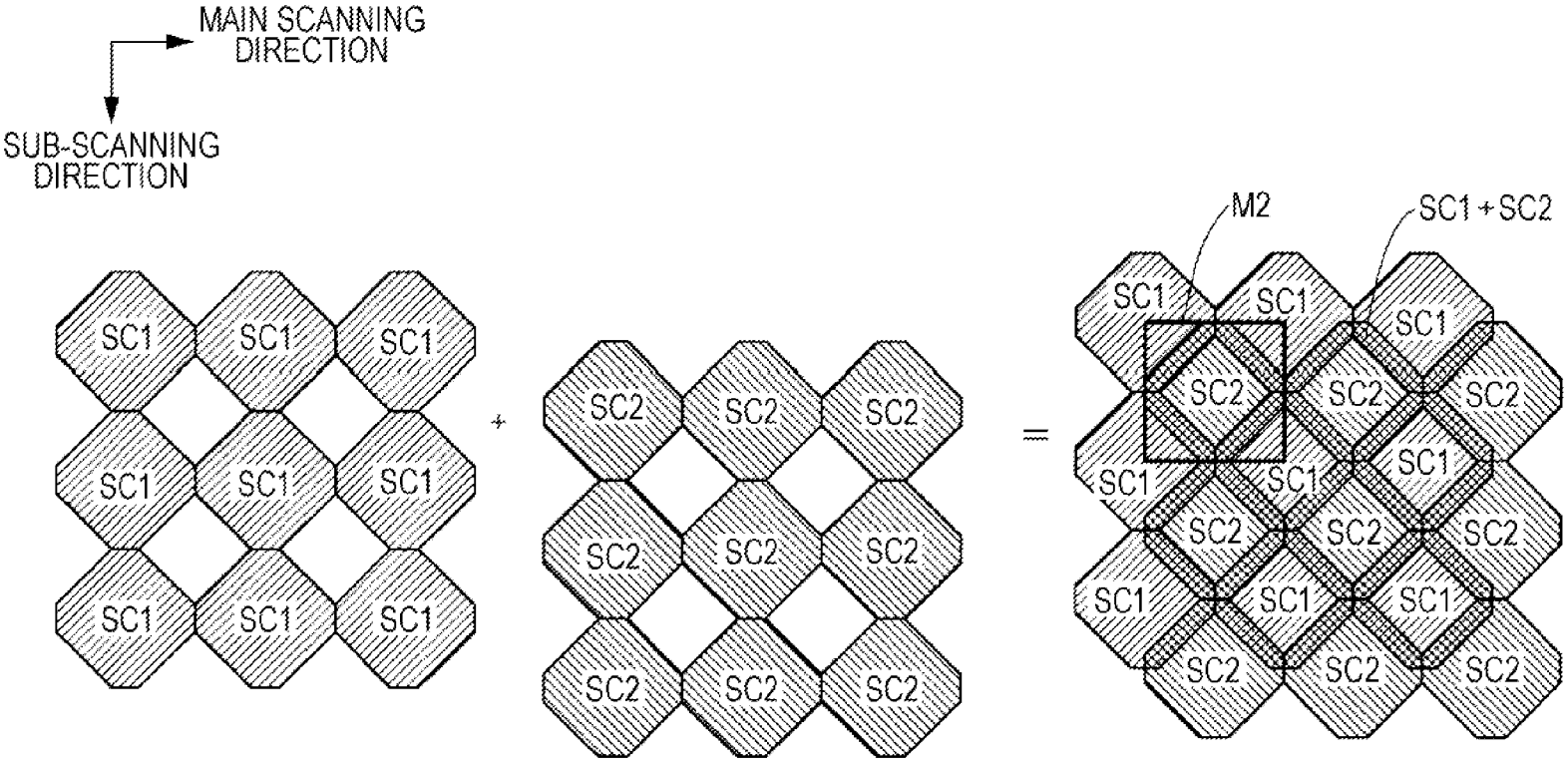
FIG. 10 is an explanatory diagram showing the super cell regions in a second embodiment.

FIG. 10 is an explanatory diagram showing the super cell regions in the second embodiment. In the second embodiment, a portion of the two super cell regions SC1 and SC2 overlaps.

Figure 11:
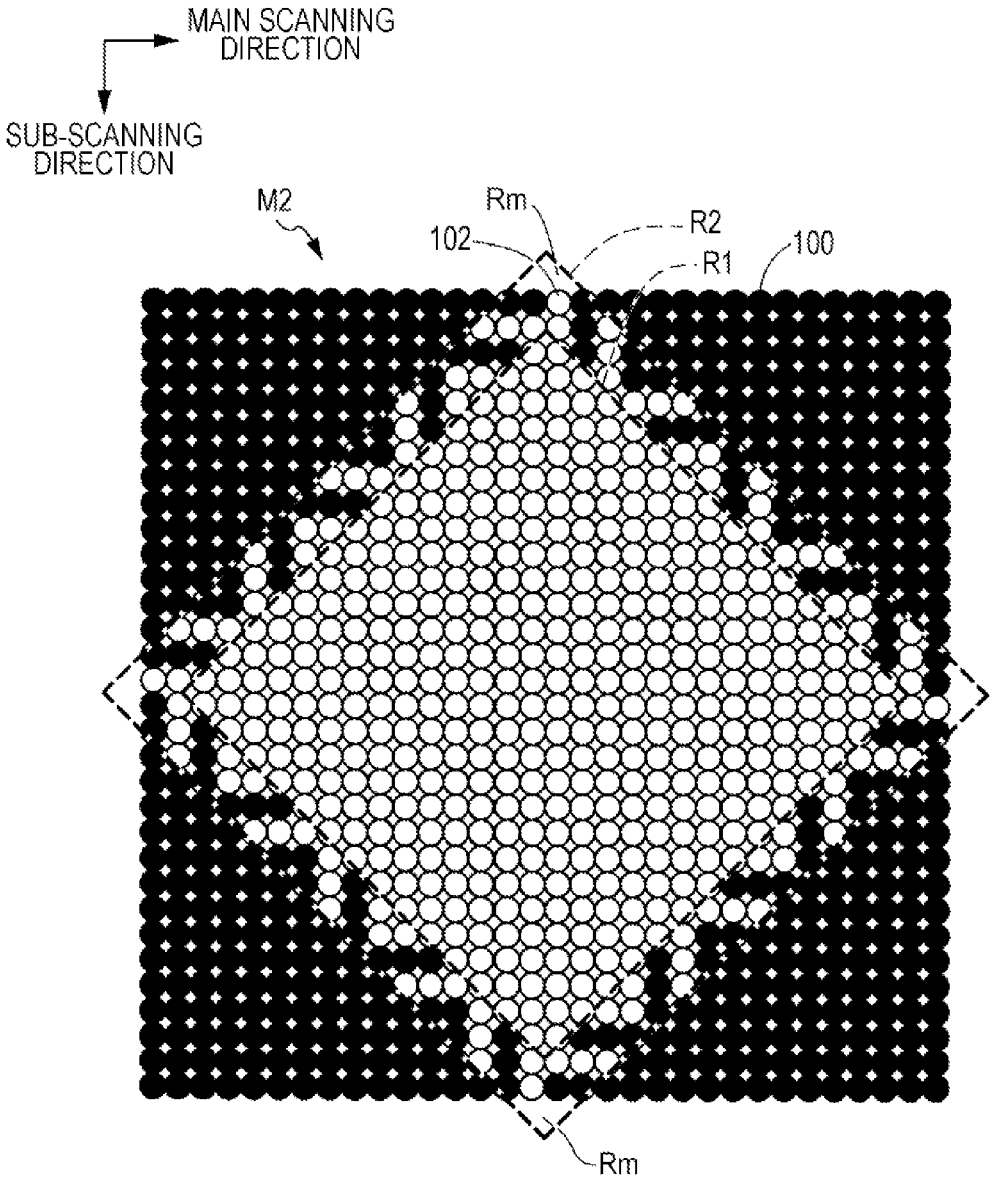
FIG. 11 is an explanatory diagram showing an example of a mask for realizing the arrangement of the super cell regions of FIG. 10.

FIG. 11 is an explanatory diagram showing an example of a mask for realizing the arrangement of the super cell regions of FIG. 10. In FIG. 11, it is assumed that the magnitude of a mask M2 is set to 32 dots×32 dots, and the nozzle row 95 includes 32 nozzles 92 in order to facilitate the comparison with the gradation described hereinafter. The black circles 100 are the pixel positions contained in the first super cell regions SC1 (the pixel positions in which the dot recording is executed in the odd pass), and the white circles 102 are the pixel positions contained in the second super cell regions SC2 (the pixel positions in which the dot recording is executed in the even pass). In FIG. 11, a first broken line R1 indicates the boundary (the outline) of the first super cell region SC1. In other words, the pixel positions in which the dot recording is performed in the odd pass are contained by the boundary R1. A second broken line R2 also indicates the boundary (the outline) of the second super cell region SC2 with the same implication. The pixel positions that fall outside of the broken line R2 are all the black circles 100, and the pixel positions that fall inside the broken line R1 are all the white circles 102. An intermediate region Rm between the broken line R1 and the broken line R2 is a region in which the first super cell regions SC1 and the second super cell regions SC2 overlap one another, and both the black circles 100 and the white circles 102 are present. As can be understood from the above description, in the second embodiment, the boundary R1 of the first super cell region SC1 is in a different position from the boundary R2 of the second super cell region SC2. In contrast, in FIG. 4 that is described above, the black circles 100 and the white circles 102 are clearly divided by a common boundary and no region is present in which the black circles 100 and the white circles 102 are both present. In this embodiment, in the intermediate region Rm in which both the black circles 100 and the white circles 102 are present (a region in which the two super cell regions SC1 and SC2 partially overlap one another), the dot recording is completed in two passes. By providing the intermediate region Rm, it is possible to render the banding less conspicuous.

In this embodiment, the contents of the intermediate region Rm are further divided into a plurality of (specifically three) layer regions. In other words, in the layer region that is directly inside of the broken line R2, the ratio of the black circles 100 to the white circles 102 is 2:1, in the layer region that is between the broken line R1 and the broken line R2, the ratio of the black circles 100 to the white circles 102 is 1:1, and in the layer region that is directly outside of the broken line R1, the ratio of the black circles 100 to the white circles 102 is 1:2. In the intermediate region Rm in which the two super cell regions SC1 and SC2 overlap one another, the ratio of the black circles 100 to the white circles 102 may change gradually. Therefore, it is possible to further render the banding less conspicuous. Thus, the mode in which, in the intermediate region Rm, the ratio of the number of the pixel positions in which the dot recording is performed in the odd pass to the number of pixel positions in which the dot recording is performed in the even pass changes as progress is made from one super cell region toward another super cell region is also referred to as "the gradation of the dot recording charge rate". Here the term "dot recording charge rate" refers to the ratio of the number of pixel positions in which the dot recording is performed in the odd pass to the number of pixel positions in which the dot recording is performed in the even pass.

It is preferable that the intermediate region Rm between the two super cell regions SC1 and SC2 does not contain either a group of the black circles 100 of p×p pixels (where p is an integer of 2 or greater) or a group of white circles 102 of p×p pixels. Here, it is preferable to use 2, 3, 4, 5 or the like as the value of p. If the intermediate region Rm is defined in this manner, the range of the intermediate region Rm becomes clearer. For the same reason, it is preferable that the boundary be defined such that the first super cell region SC1 does not contain a group of the white circles 102 of p×p pixels (where p is an integer of 2 or greater), and that the boundary be defined such that the second super cell region SC2 does not contain a group of the black circles 100 of p×p pixels.

Figure 12:
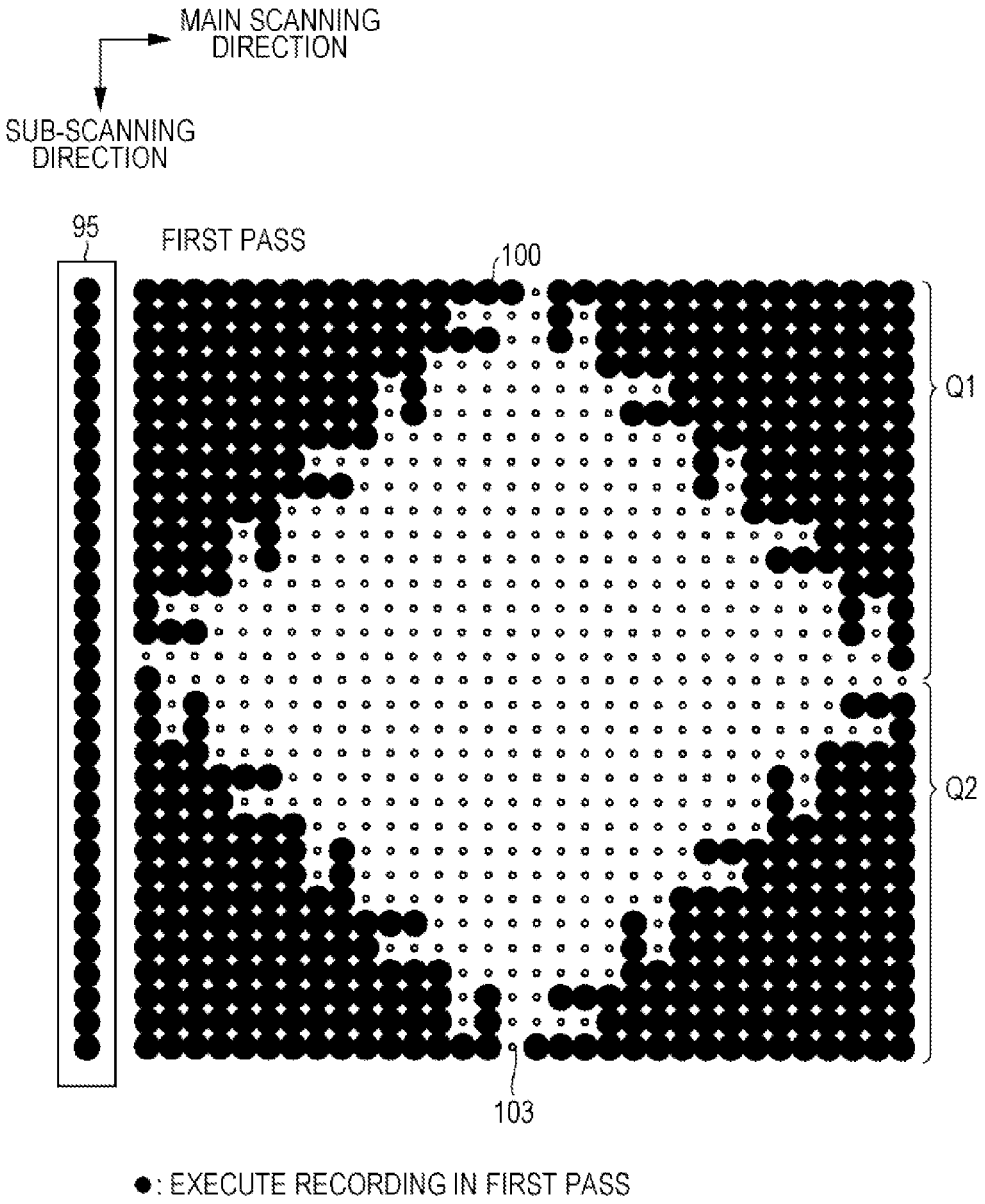
FIG. 12 is an explanatory diagram showing a state in which the dot recording is executed in the first pass in the second embodiment.

FIG. 12 is an explanatory diagram showing a state in which the dot recording is executed in the first pass in the second embodiment. The nozzle row 95 is shown on the left side and the state of 32×32 dots of recording is shown on the right side. In the first pass, the dot recording is executed in relation to the first super cell regions SC1 (the regions indicated by the black circles 100) within the regions Q1 and Q2, and the dot recording is not executed in relation to the second super cell regions SC2 (the regions indicated by the small white circles 103).

Figure 13:
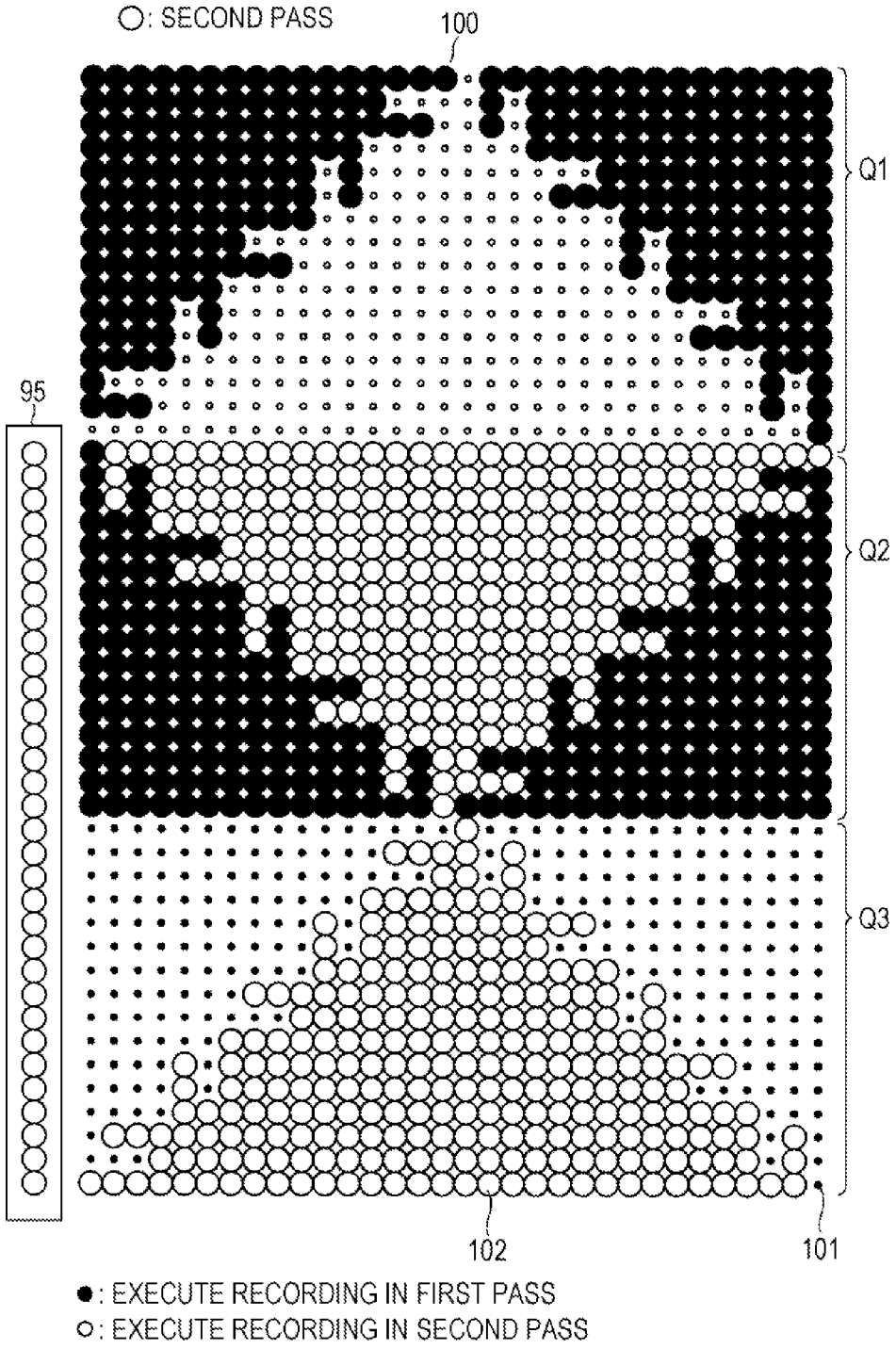
FIG. 13 is an explanatory diagram showing a state in which the dot recording is executed in the second pass in the second embodiment.

FIG. 13 is an explanatory diagram showing a state in which the dot recording is executed in the second pass in the second embodiment. In the second pass, the nozzle row 95 is shifted by 16 dots in the sub-scanning direction; subsequently, the dot recording is executed in relation to the pixels that belong to the second super cell regions SC2 (the regions indicated by the large white circles 102) within the regions Q2 and Q3, and the dot recording is not executed in relation to the pixels that belong to the first super cell regions SC1 (the regions indicated by the small black circles 101). The region Q2 is filled with all of the dots of the large black circles 100 and white circles 102. Since it is not possible to clearly recognize the boundary R1 of the first super cell regions SC1 or the boundary R2 of the second super cell regions SC2 even when observing the image that is printed in this manner with the naked eye, it is possible to render the banding less conspicuous.

Figure 14:
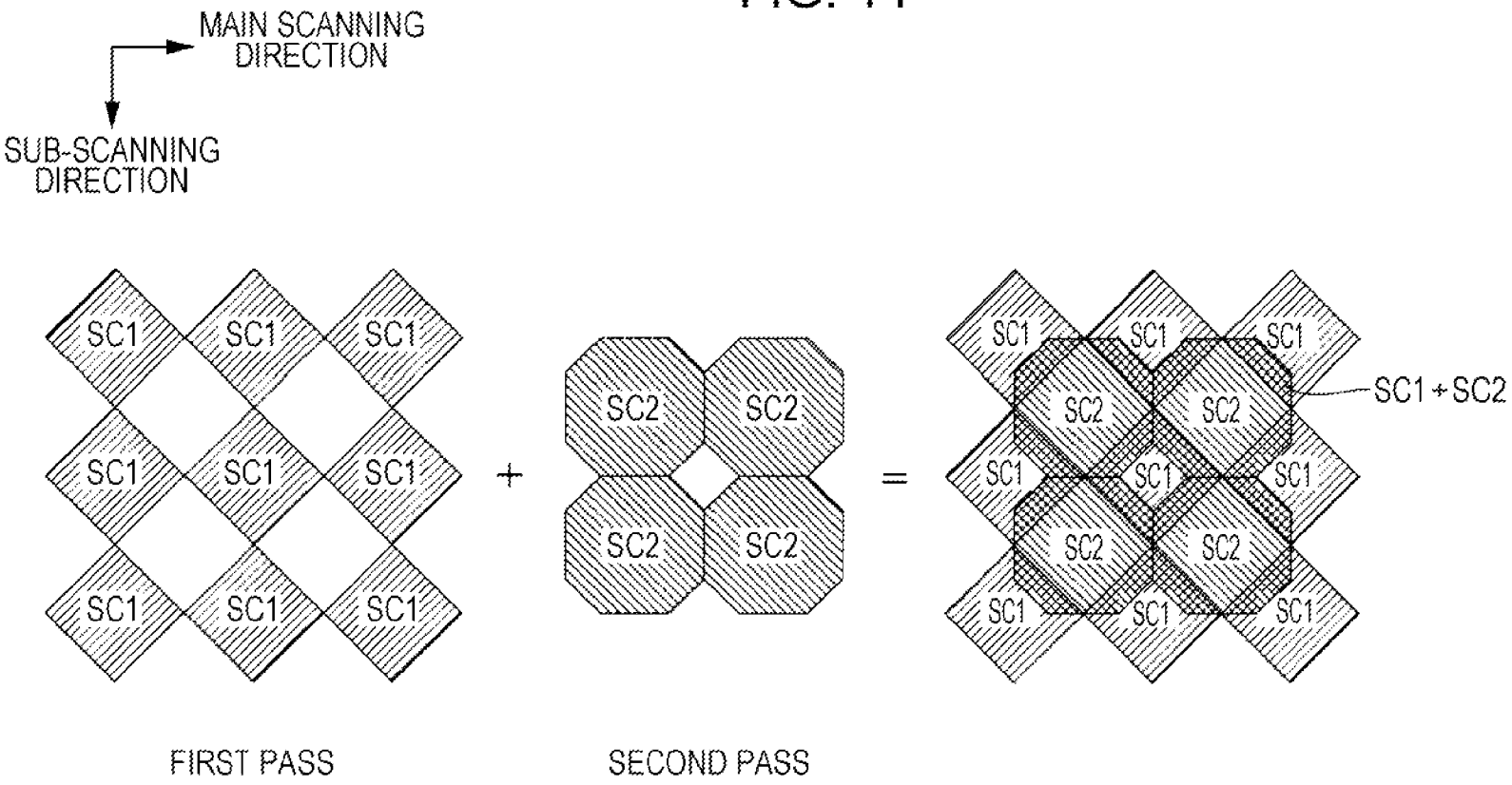
FIG. 14 is an explanatory diagram showing a modification example of the second embodiment.

FIG. 14 is an explanatory diagram showing a modification example of the second embodiment. In the embodiments described using FIGS. 10 to 13, the two super cell regions SC1 and SC2 have the same shape; however, in the example shown in FIG. 14, the shapes differ from one another. Specifically, the first super cell regions SC1 have a rhombic shape; however, the second super cell regions SC2 have an octagonal shape. In this manner, the shapes of the super cell regions SC1 and the super cell regions SC2 do not have to be the same. As in the second embodiment, it is preferable that the boundary R1 of the first super cell regions SC1 and the boundary R2 of the second super cell regions SC2 not be present in the same position, and that even when present in different positions, at least a portion of each of the boundaries R1 and R2 contain a boundary portion that is not parallel to either the main scanning direction or the sub-scanning direction. It is particularly preferable that all of the boundaries R1 and R2 contain a boundary portion that is not parallel to either the main scanning direction or the sub-scanning direction. Therefore, it is possible to render the banding along the main scanning direction and the sub-scanning direction less conspicuous.

Third Embodiment

Figure 15:
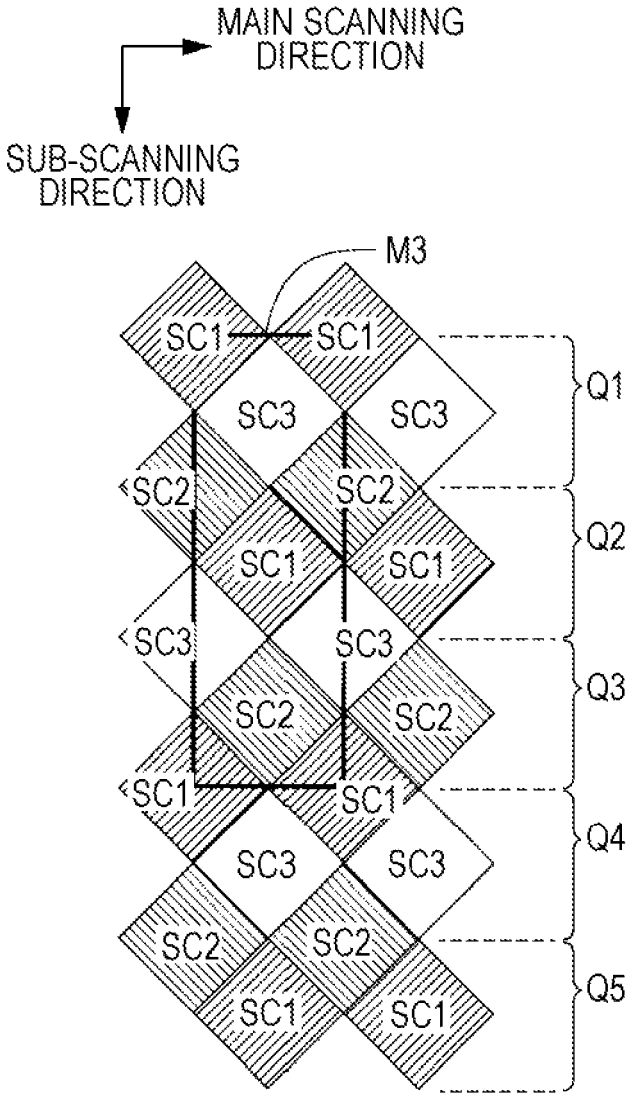
FIG. 15 is an explanatory diagram showing the super cell regions of a third embodiment.

FIG. 15 is an explanatory diagram showing the super cell regions of a third embodiment. In the third embodiment, the dot recording on each of the main scan lines is completed in three passes. Specifically, dots are recorded on the first super cell regions SC1 in the first (3q+first, where q is an integer of 0 or greater) pass, dots are recorded on the second super cell region SC2 in the second (3q+second) pass, and dots are recorded on a third super cell region SC3 in the third (3q+third) pass. In this embodiment, the three super cell regions SC1 to SC3 have the same shape. However, the shapes and magnitudes of the three super cell regions SC1 to SC3 may be different. A mask M3 is used in order to realize the arrangement pattern of the three super cell regions SC1 to SC3.

Figure 16:
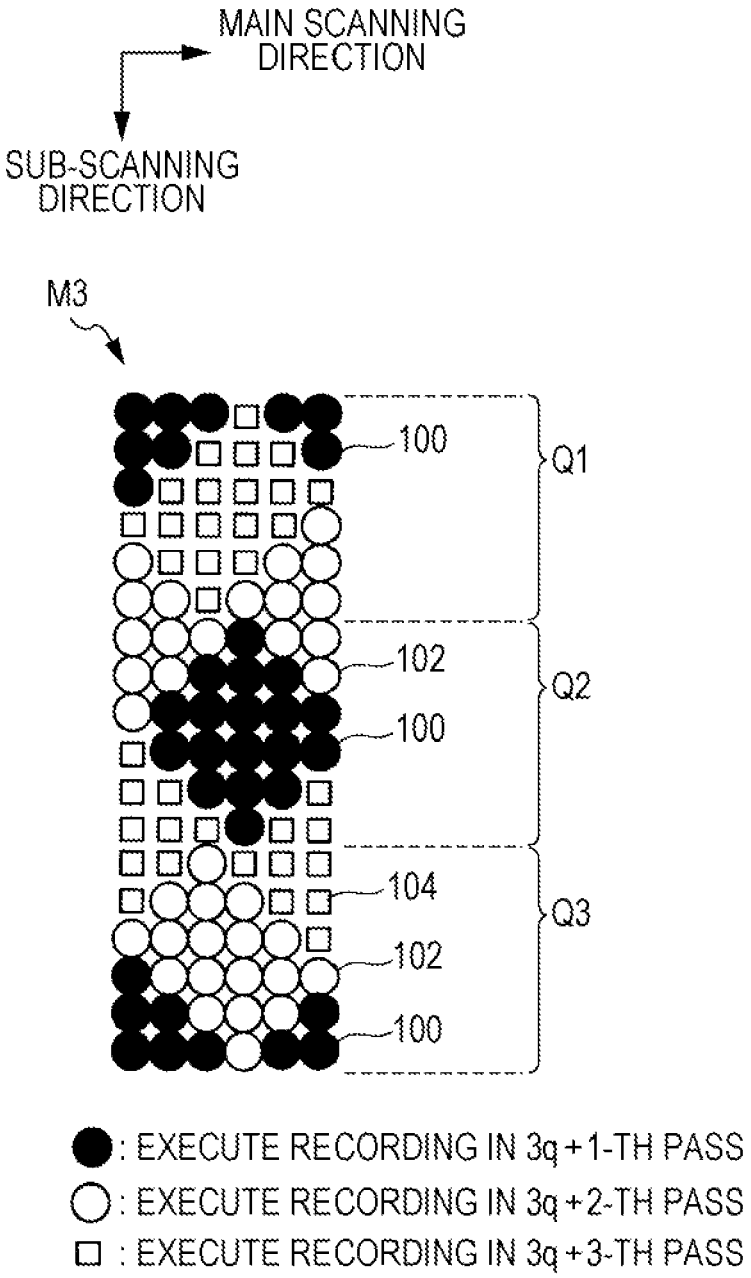
FIG. 16 is an explanatory diagram showing a mask in the third embodiment.

FIG. 16 is an explanatory diagram showing a mask M3 in the third embodiment. Here, it is assumed that the magnitude of the mask M3 is set to 6 dots×18 dots for convenience of illustration. The black circles 100 are the pixel positions of the first super cell regions SC1, and dots are recorded thereon in the 3q+first (where q is an integer of 0 or greater) pass. The white circles 102 are the pixel positions of the second super cell regions SC2, and dots are recorded thereon in the 3q+second pass. Outlined white squares 104 are the pixel positions of the third super cell regions SC3, and dots are recorded thereon in the 3q+third pass.

Figure 17:
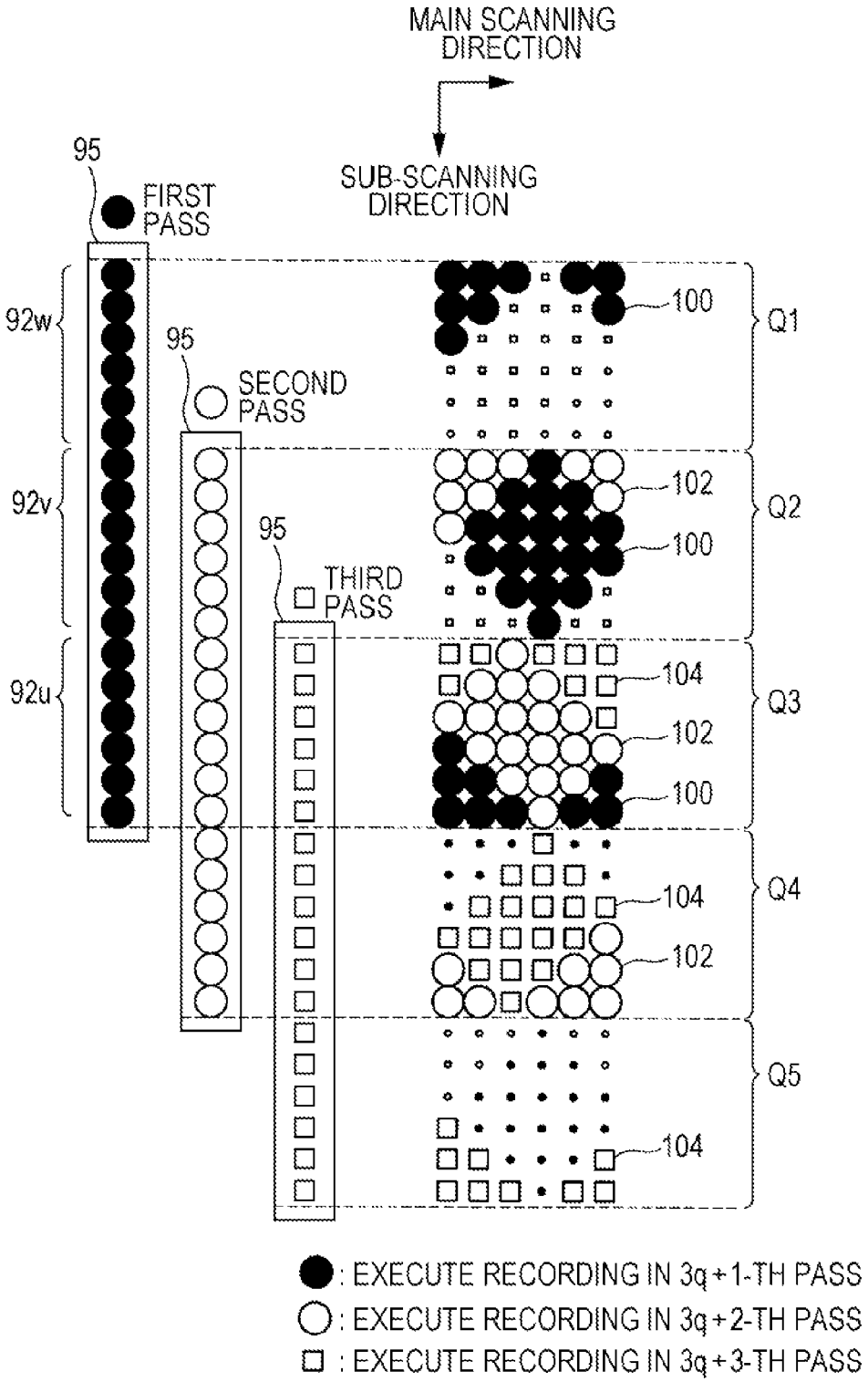
FIG. 17 is an explanatory diagram showing a recording state of the dots that are recorded from the first to third passes in the third embodiment.

FIG. 17 is an explanatory diagram showing a recording state of the dots that are recorded from the first to third passes in the third embodiment. The position of the nozzle row 95 is shown on the left side in each pass and the state of 6×30 pixels of the dot recording is shown on the right side. In the first pass, the dots of the first super cell regions SC1 (the dots indicated by the large black circles 100) of FIG. 15 within the regions Q1 to Q3 are recorded. In the second pass, the nozzle row 95 is shifted by 6 dots in the sub-scanning direction, the dots of the second super cell regions SC2 (the dots indicated by the large white circles 102) of FIG. 15 within the regions Q2 to Q4 are recorded, and in the third pass, the nozzle row 95 is shifted further by 6 dots in the sub-scanning direction and the dots of the third super cell regions SC3 (the dots indicated by the outlined white squares 104) of FIG. 15 within the regions Q3 to Q5 are recorded. As a result, the dot recording in relation to all the pixels of the region Q3 is completed through three passes. Subsequently, when the fourth pass onward is executed, the dot recording in relation to all the pixels of each region of the region Q4 onward is sequentially completed. In a region Qn in which the dot recording is completed, all of the dots are one of the black circles 100, the white circles 102 or the outlined white squares 104. The sum of the white circles 102 and the outlined white squares 104 is complementary to the black circles 100, the sum of the outlined white squares 104 and the black circles 100 is complementary to the white circles 102, and the sum of the black circles 100 and the white circles 102 is complementary to the outlined white squares 104.

According to the third embodiment, dots are recorded on the first region Qn (where n is a natural number) in the third pass, and neither of two arbitrary boundaries of the super cell regions, of the three super cell regions SC1 to SC3 to be recorded on in each pass, is parallel to the main scanning direction or the sub-scanning direction. Thus, the banding that is parallel to the main scanning direction and the banding that is parallel to the sub-scanning direction do not occur easily, and it is possible to render the banding in the entire image less conspicuous.

Fourth Embodiment

Figure 18:
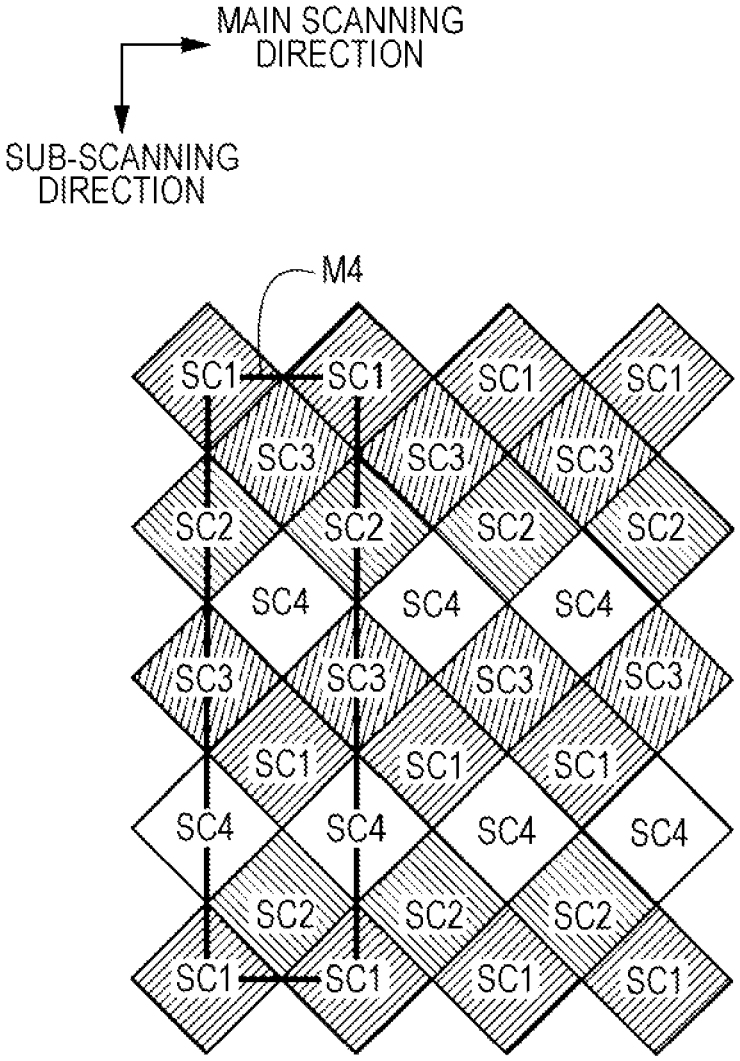
FIG. 18 is an explanatory diagram showing the super cell regions of a fourth embodiment.

FIG. 18 is an explanatory diagram showing the super cell regions of a fourth embodiment. In the fourth embodiment, dots are recorded on the first super cell regions SC1 in the first (4q+first, where q is an integer of 0 or greater) pass, dots are recorded on the second super cell regions SC2 in the second (4q+second) pass, dots are recorded on the third super cell regions SC3 in the third (4q+third) pass, and dots are recorded on fourth super cell regions SC4 in the fourth (4q+fourth) pass. In this embodiment, the four super cell regions SC1 to SC4 have the same shape. However, the shapes and magnitudes of the four super cell regions SC1 to SC4may be different. A mask M4 is used in order to realize the arrangement pattern of the four super cell regions SC1 to SC4.

Figure 19:
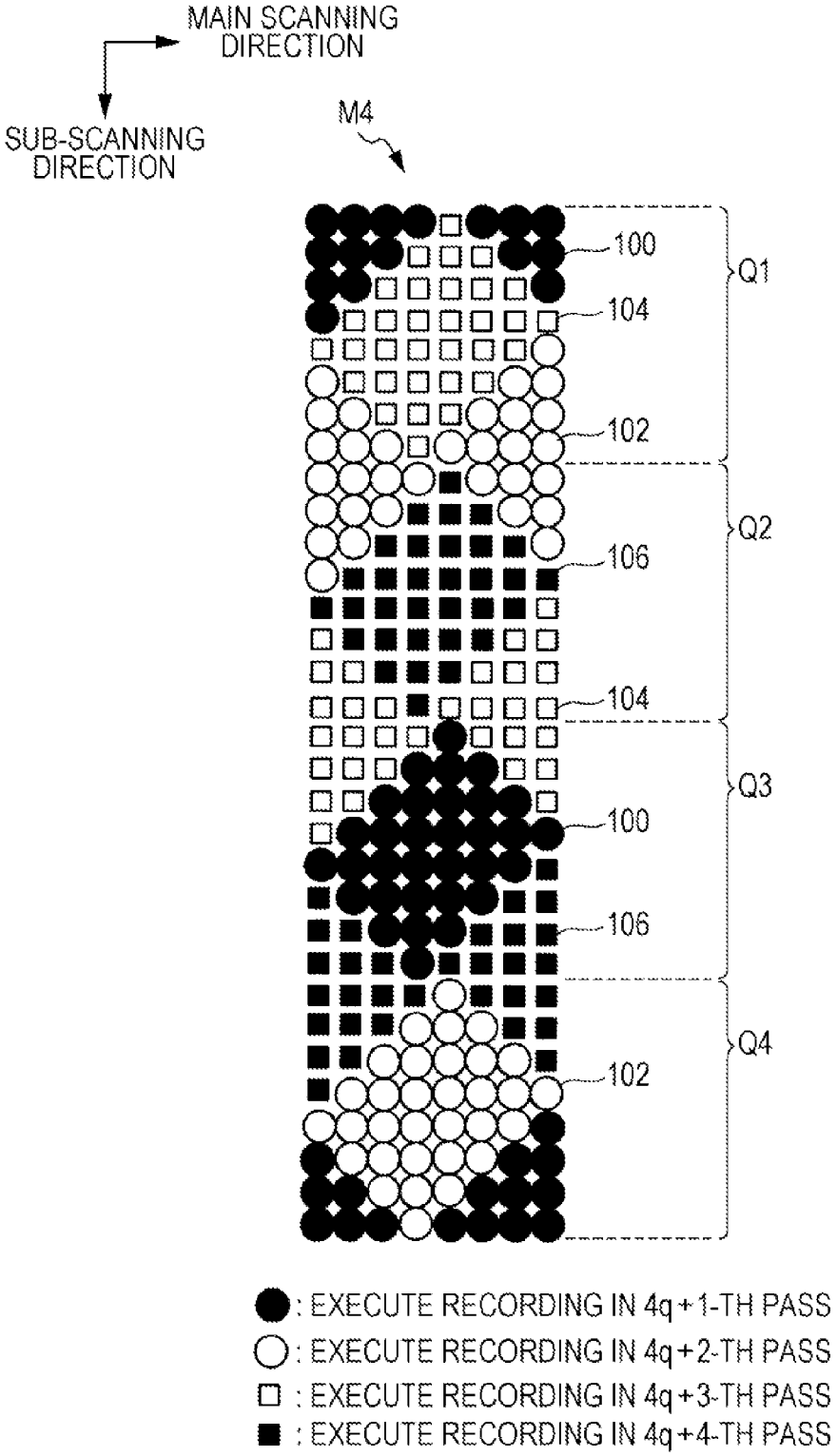
FIG. 19 is an explanatory diagram showing, in relation to the fourth embodiment, the dot recording pattern in each pass and a mask for creating the dot recording pattern.

FIG. 19 is an explanatory diagram showing, in relation to the fourth embodiment, the dot recording pattern in each pass and the mask M4 for creating the dot recording pattern. Here, it is assumed that the magnitude of the mask M4 is set to 8 dots×32 dots for convenience of illustration. The black circles 100 are the pixel positions of the dots of the first super cell regions SC1, and dots are recorded thereon in the 4q+first (where q is an integer of 0 or greater) pass. The white circles 102 are the pixel positions of the second super cell regions SC2, and dots are recorded thereon in the 4q+second pass. The outlined white squares 104 are the pixel positions of the third super cell regions SC3, and dots are recorded thereon in the 4q+third pass. Filled black squares 106 are the pixel positions of the fourth super cell regions SC4, and dots are recorded thereon in the 4q+fourth pass. Since the dot recording in each pass is the same as that of the first and third embodiments, description thereof will be omitted.

In the fourth embodiment, since no portion of the boundaries of each of the super cell regions is parallel to the main scanning direction or the sub-scanning direction, banding that is parallel to the main scanning direction or the sub-scanning direction does not occur easily.

Fifth Embodiment

Figure 20A:
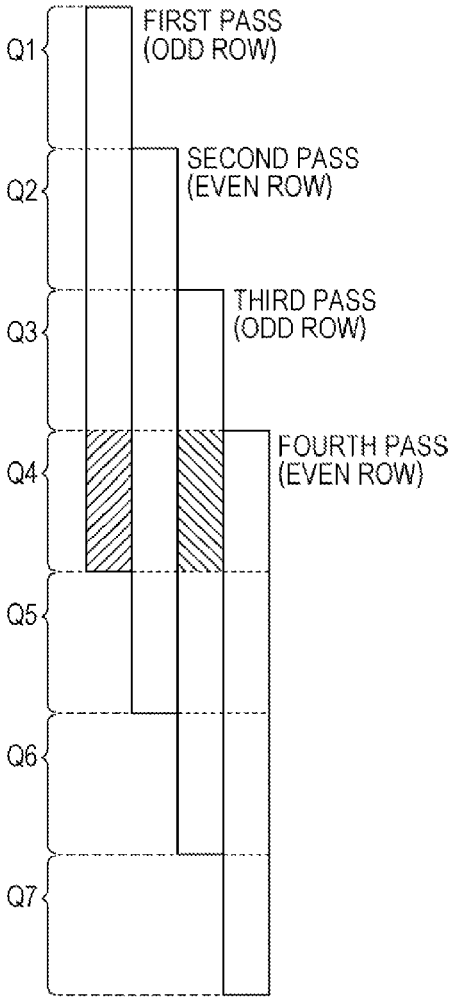
FIGS. 20A and 20B are explanatory diagrams showing, in relation to a fifth embodiment, the positions of the nozzle row in four passes, and the recording regions in relation to the positions.
Figure 20B:
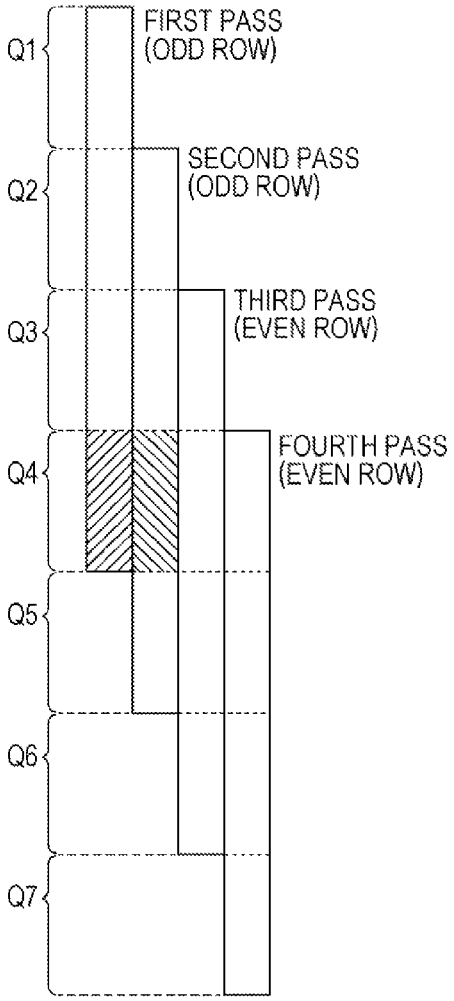

FIGS. 20A and 20B are explanatory diagrams showing, in relation to a fifth embodiment, the positions of the nozzle row 95 in four passes, and the recording regions in relation to the positions. In the same manner as the fourth embodiment, in the fifth embodiment, the dot recording is performed in four passes; however, the fifth embodiment differs from the fourth embodiment in that the pixel positions of odd rows are recorded divided into two passes and the pixel positions of the even rows are also recorded divided into two passes. In the case of the first scan example shown in FIG. 20A, the pixel positions of the odd rows are recorded in the first and third passes, and the even rows are recorded in the second and fourth passes. In the case of the second scan example shown in FIG. 20B, the pixel positions of the odd rows are recorded in the first and second passes, and the even rows are recorded in the third and fourth passes.

Figure 21:
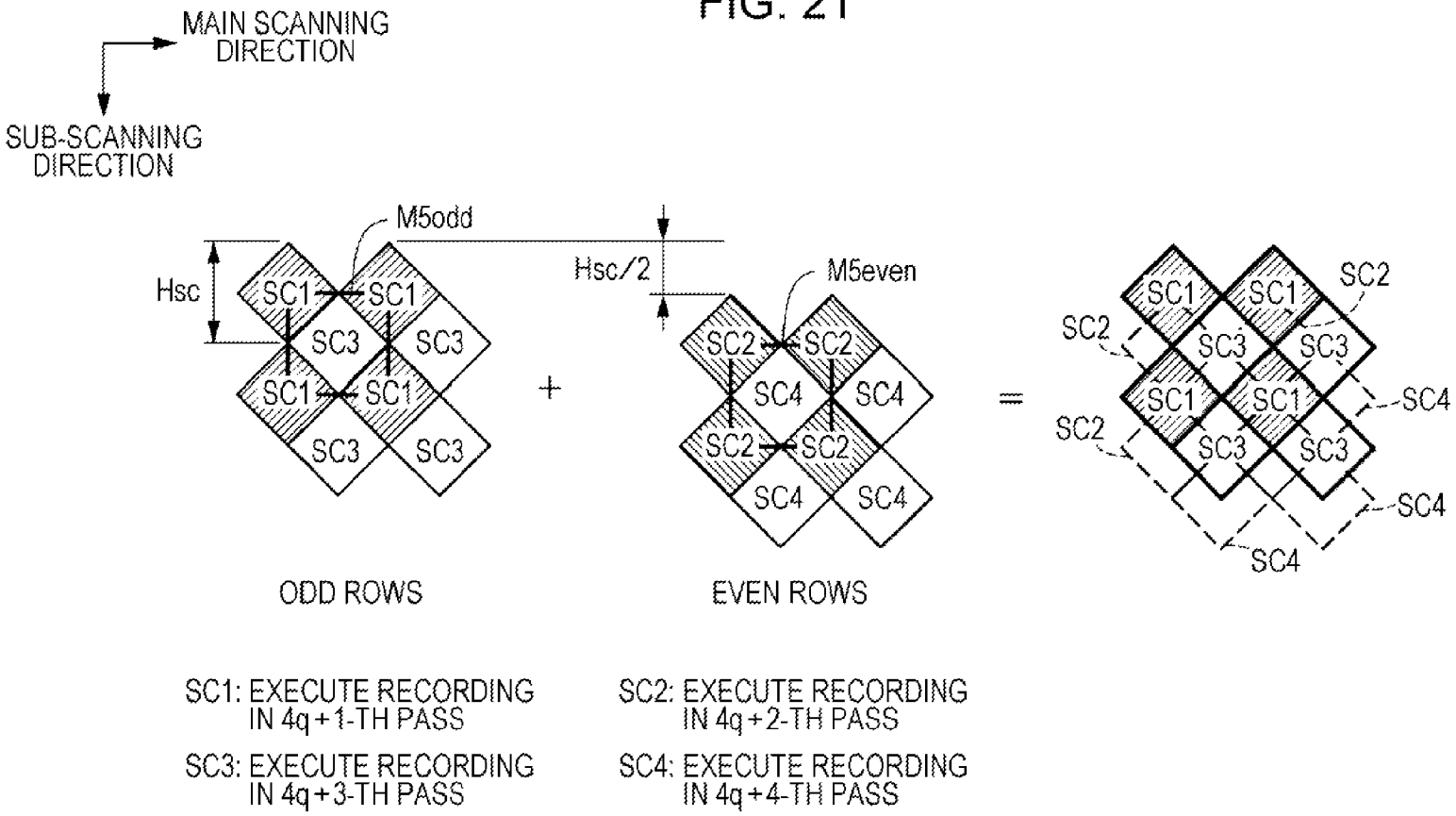
FIG. 21 is an explanatory diagram showing the super cell regions that are used in the first scan example shown in FIG. 20A.

FIG. 21 is an explanatory diagram showing the super cell regions that are used in the first scan example shown in FIG. 20A. In the super cell regions SC1 and SC3, the dots are recorded on the pixel positions of the odd rows in the first and third passes, and the super cell regions SC1 and SC3 correspond to the super cell regions SC1 and SC2 in the first and second embodiments, respectively. In the super cell regions SC2 and SC4, the dots are recorded on the pixel positions of the even rows in the second and fourth passes, and the super cell regions SC2 and SC4 correspond to the super cell regions SC1 and SC2 in the first and second embodiments, respectively. In this embodiment, the super cell regions SC1 to SC4 have the same magnitude and shape. Each of the super cell regions SC1 to SC4 is arranged such that the boundary of the super cell regions SC1 and SC3 and the boundary of the super cell regions SC2 and SC4 do not overlap one another. Specifically, each of the super cell regions SC1 to SC4 is arranged such that the super cell regions SC1 and the super cell regions SC2 are shifted in the sub-scanning direction by ½ of the height Hsc of the super cell regions SC1.

Figure 22:
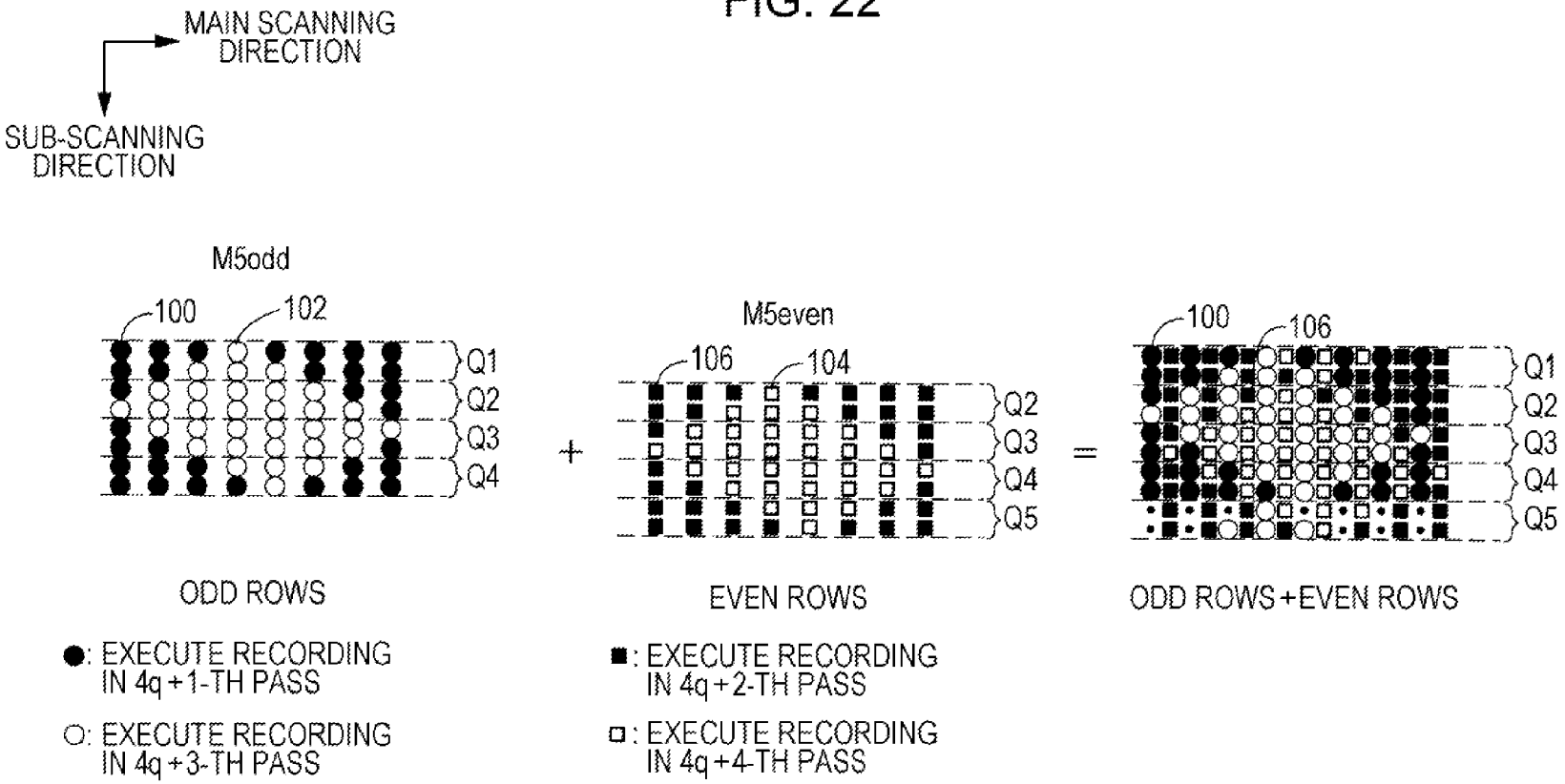
FIG. 22 is an explanatory diagram showing masks for realizing the super cell regions of FIG. 21.

FIG. 22 is an explanatory diagram showing masks M5 odd and M5 even for realizing the super cell regions of FIG. 21. In the masks M5odd that is used in the odd rows and M5even that is used in the even rows, the odd rows and the even rows are simply switched with one another and are similar in practice. The black circles 100 of the mask M5odd correspond to the pixel positions of the first super cell regions SC1, and the dot recording is performed thereon in the 4q+first (where q is an integer of 0 or greater) pass. The white circles 102 of the mask M5odd correspond to the dots of the third super cell regions SC3, and the dot recording is performed thereon in the 4q+third pass. The filled black squares 106 of the mask M5even correspond to the dots of the second super cell regions SC2, and the dot recording is performed thereon in the 4q+second pass. The outlined white squares 104 of the mask M5even correspond to the dots of the fourth super cell regions SC4, and the dot recording is performed thereon in the 4q+fourth pass.

Figure 23:
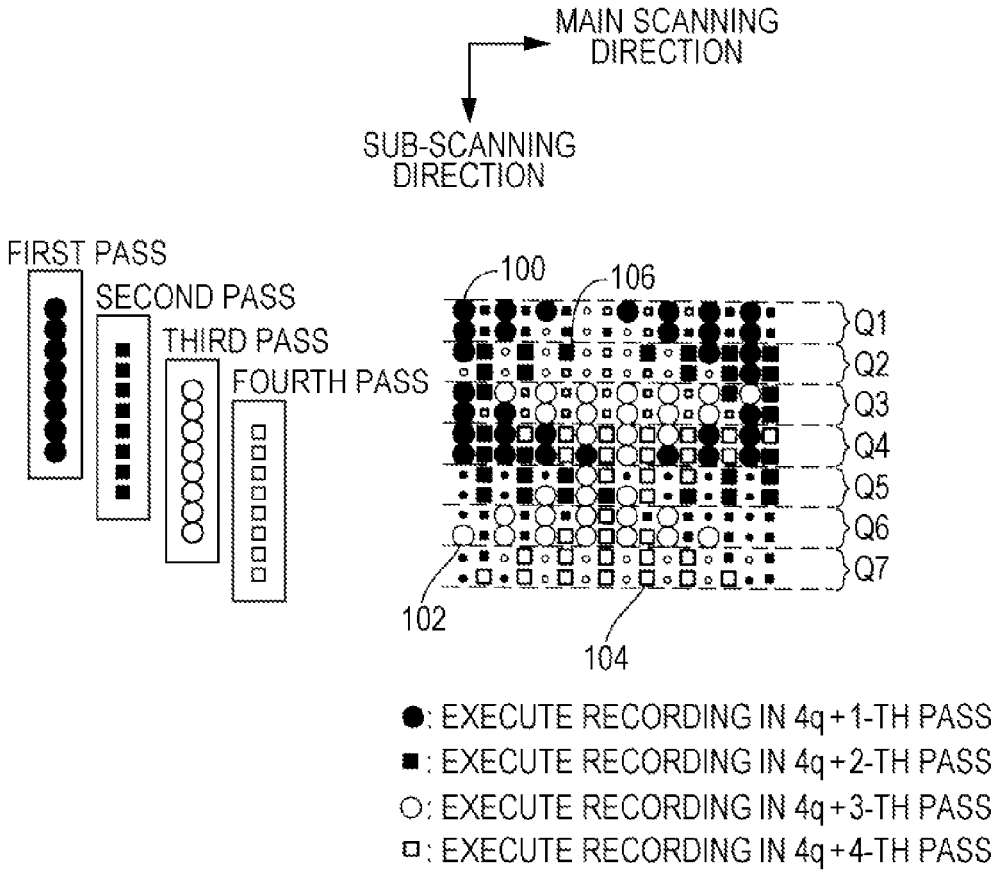
FIG. 23 is an explanatory diagram showing the dots in each pass of the first scan example shown in FIG. 20A.

FIG. 23 is an explanatory diagram showing the dots in each pass of the first scan example shown in FIG. 20A. In the first pass, the dots that are defined by the black circles 100 are formed in the pixel positions of the odd rows of the regions Q1 to Q4. In the second pass, the nozzle row 95 is shifted by 2 dots in the sub-scanning direction; and subsequently, the dots that are defined by the filled black squares 106 are formed in the pixel positions of the even rows of the regions Q2 to Q5. In the third pass, the nozzle row 95 is shifted by 2 dots in the sub-scanning direction; and subsequently, the dots that are defined by the white circles 102 are formed in the pixel positions of the odd rows of the regions Q3 to Q6. In the fourth pass, the nozzle row 95 is shifted by 2 dots in the sub-scanning direction; and subsequently, the dots that are defined by the outlined white squares 104 are formed in the pixel positions of the even rows of the regions Q2 to Q5.

In regard to the fifth embodiment, neither the boundary of the super cell regions SC1 and SC3 or the boundary of the super cell regions SC2 and SC4 is parallel to the main scanning direction or the sub-scanning direction. Thus, the banding that is parallel to the main scanning direction and the banding that is parallel to the sub-scanning direction do not occur easily, and it is possible to render the banding in the entire image less conspicuous. The boundary of the super cell regions SC1 and SC3 that correspond to the pixel positions of the odd rows and the boundary of the super cell regions SC2 and SC4 that correspond to the pixel positions of the even rows do not overlap one another. Thus it is possible to render the banding less conspicuous.

Figure 24:
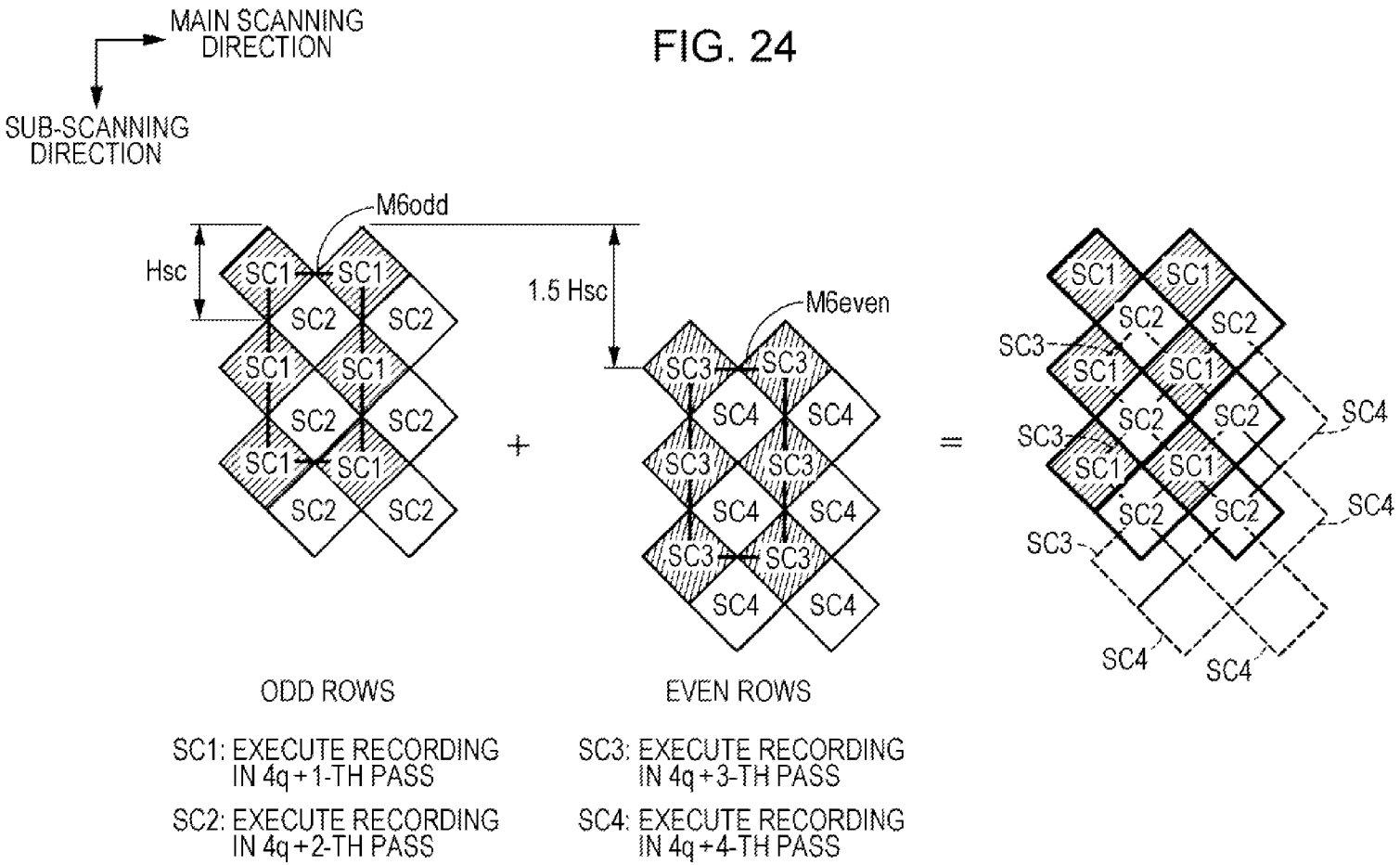
FIG. 24 is an explanatory diagram showing the super cell regions in the second scan example shown in FIG. 20B.

FIG. 24 is an explanatory diagram showing the super cell regions that are used in the second scan example shown in FIG. 20B. In the super cell regions SC1 and SC2, the dots are recorded on the pixel positions of the odd rows in the first and second passes, and the super cell regions SC1 and SC2 correspond to the super cell regions SC1 and SC2 in the first and second embodiments, respectively. In the super cell regions SC3 and SC4, the dots are recorded on the pixel positions of the even rows in the third and fourth passes, and the super cell regions SC3 and SC4 correspond to the super cell regions SC1 and SC2 in the first and second embodiments, respectively. In this embodiment, the super cell regions SC1 to SC4 have the same magnitude and shape. Each of the super cell regions SC1 to SC4 is arranged such that the boundary of the super cell regions SC1 and SC2 and the boundary of the super cell regions SC3 and SC4 do not overlap one another. Specifically, each of the super cell regions SC1 to SC4 is arranged such that the super cell regions SC1 and the super cell regions SC3 are shifted in the sub-scanning direction by 3/2 of the height Hsc of the super cell regions SC1.

Figure 25:
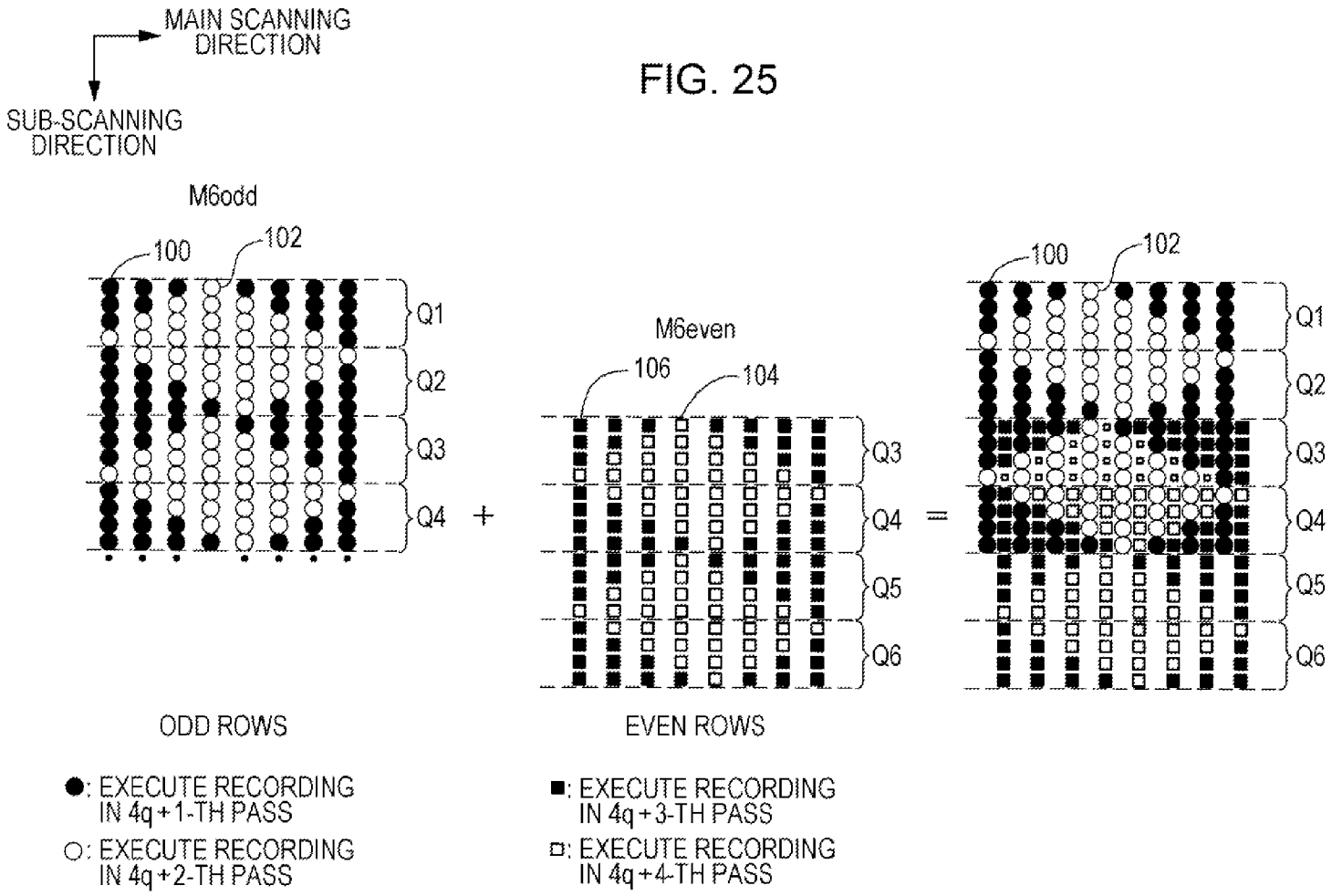
FIG. 25 is an explanatory diagram showing masks for realizing the super cell regions of FIG. 24.

FIG. 25 is an explanatory diagram showing masks M6odd and M6even for realizing the super cell regions of FIG. 24. In the masks M6odd that is used in the odd rows and M6even that is used in the even rows, the odd rows and the even rows are simply switched with one another and are similar in practice. The black circles 100 of the mask M6odd correspond to the pixel positions of the first super cell regions SC1, and the dot recording is performed thereon in the 4q+first (where q is an integer of 0 or greater) pass. The white circles 102 of the mask M6odd correspond to the pixel positions of the second super cell regions SC2, and the dot recording is performed thereon in the 4q+second pass. The filled black squares 106 of the mask M6even correspond to the pixel positions of the third super cell regions SC3, and the dot recording is performed thereon in the 4q+third pass. The outlined white squares 104 of the mask M6even correspond to the pixel positions of the fourth super cell regions SC4, and the dot recording is performed thereon in the 4q+fourth pass.

Figure 26:
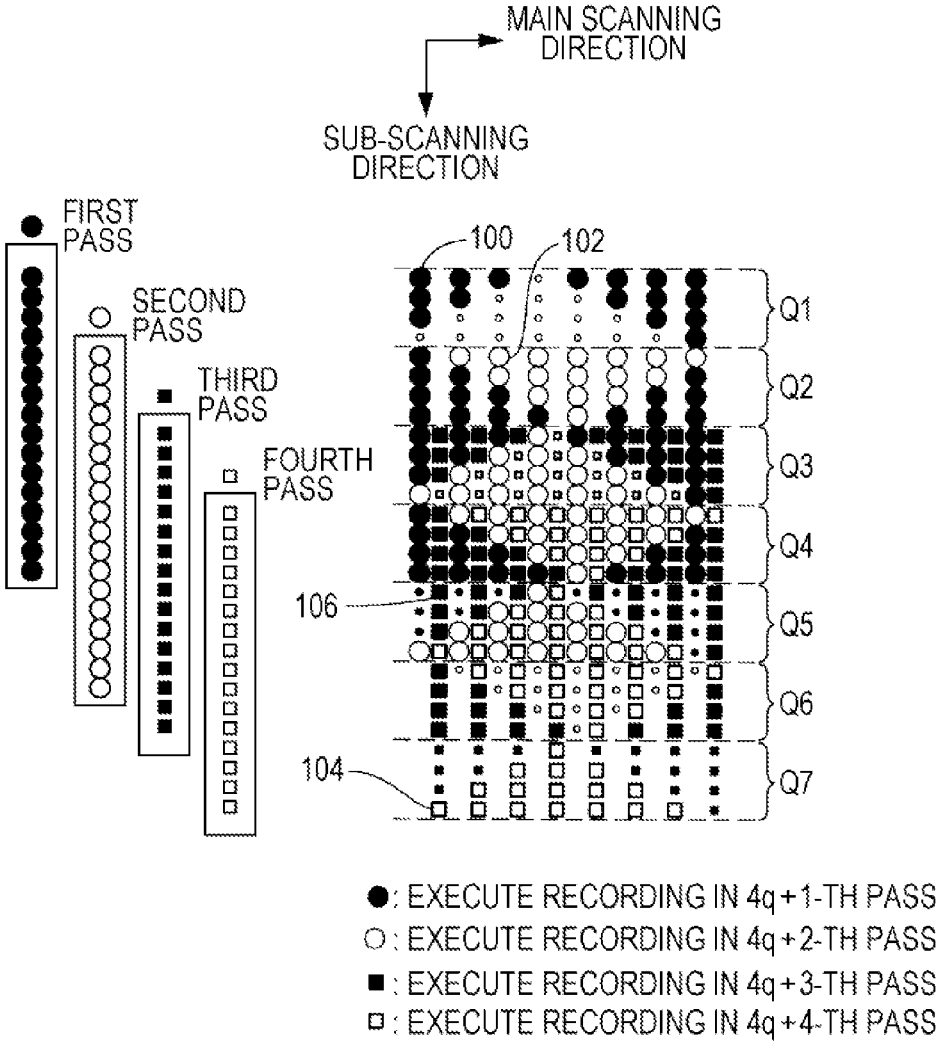
FIG. 26 is an explanatory diagram showing the dots in each pass of the second scan example shown in FIG. 20B.

FIG. 26 is an explanatory diagram showing the dots in each pass of the second scan example shown in FIG. 20B. In the first pass, the dots that are defined by the black circles 100 are formed in the pixel positions of the odd rows of the regions Q1 to Q4. In the second pass, the nozzle row 95 is shifted by 4 dots in the sub-scanning direction; and subsequently, the dots that are defined by the white circles 102 are formed in the pixel positions of the odd rows of the regions Q2 to Q5. In the third pass, the nozzle row 95 is shifted by 4 dots in the sub-scanning direction; and subsequently, the dots that are defined by the filled black squares 106 are formed in the pixel positions of the odd rows of the regions Q3 to Q6. In the fourth pass, the nozzle row 95 is shifted by 4 dots in the sub-scanning direction; and subsequently, the dots that are defined by the outlined white squares 104 are formed in the pixel positions of the even rows of the regions Q4 to Q7.

In regard to this embodiment, neither the boundary of the super cell regions SC1 and SC2 or the boundary of the super cell regions SC3 and SC4 is parallel to the main scanning direction or the sub-scanning direction. Thus, the banding that is parallel to the main scanning direction and the banding that is parallel to the sub-scanning direction do not occur easily, and it is possible to render the banding in the entire image less conspicuous. Since the boundary of the super cell regions SC1 and SC2 and the boundary of the super cell regions SC3 and SC4 do not overlap one another, it is possible to render the banding less conspicuous. The masks M5odd and M5even (FIG. 21) that are used in the first scan example of FIG. 20A are preferable in that it is possible to render the magnitude thereof smaller than that of the masks M6odd and M6even (FIG. 24) that are used in the second scan example of FIG. 20B.

Sixth Embodiment

Figure 27:
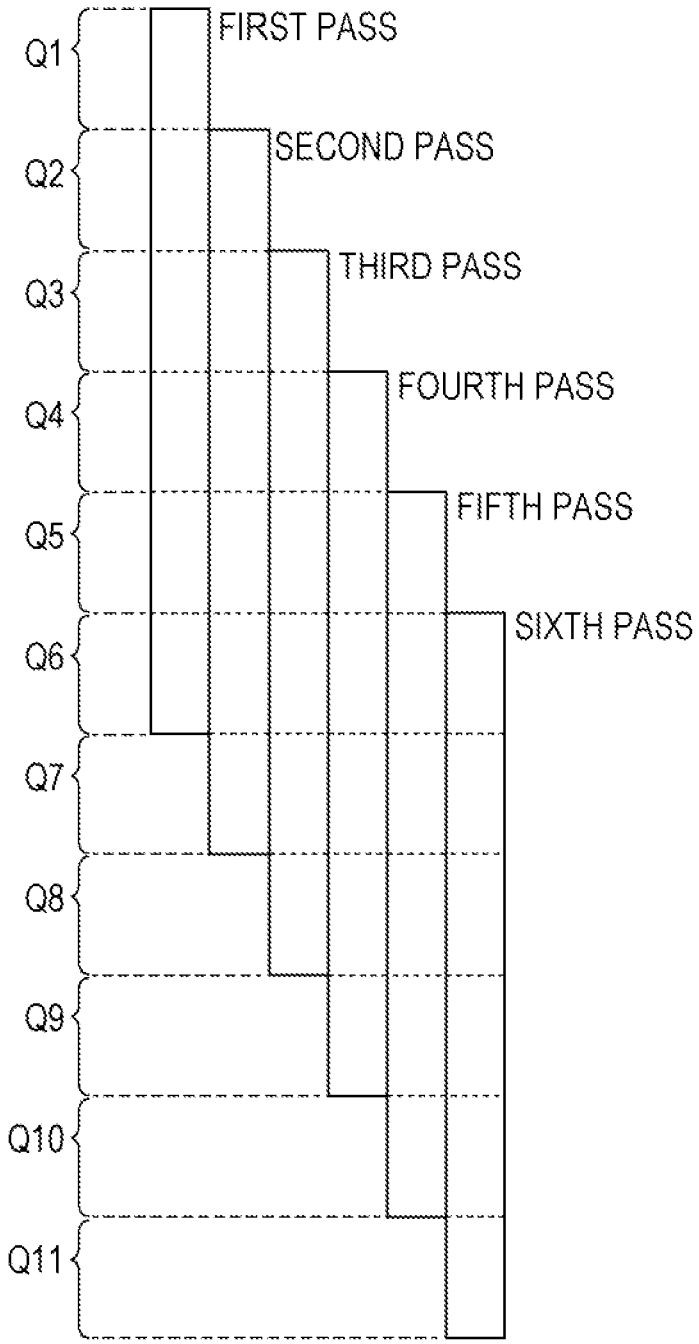
FIG. 27 is an explanatory diagram showing, in relation to a sixth embodiment, the positions of the nozzle row in six passes, and the recording regions in relation to the positions.

FIG. 27 is an explanatory diagram showing, in relation to the sixth embodiment, the positions of the nozzle row 95 in six passes, and the recording regions in relation to the positions. In the sixth embodiment, on each main scan line, the dot recording is completed in six passes.

Figure 28:
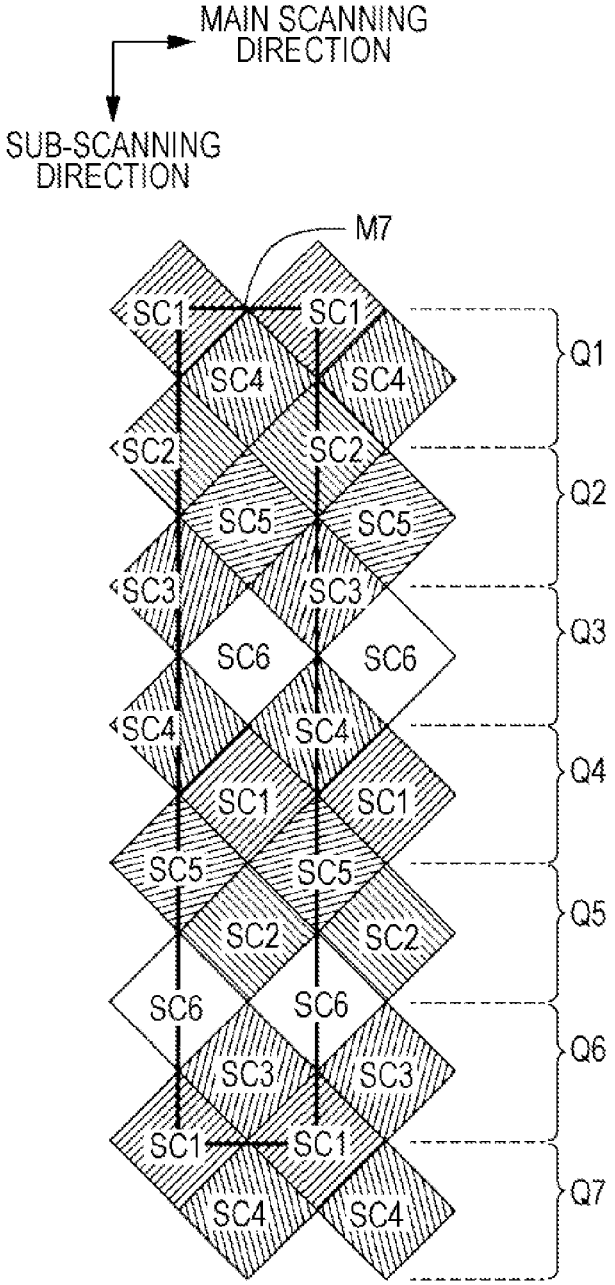
FIG. 28 is a diagram showing a configuration example in which the super cell regions are lined up in the sub-scanning direction.

FIG. 28 is a diagram showing a configuration example in which the super cell regions are lined up in the sub-scanning direction. An example of the shape and the arrangement of a mask M7 that realizes the six super cell regions is illustrated in FIG. 28.

Figure 29:
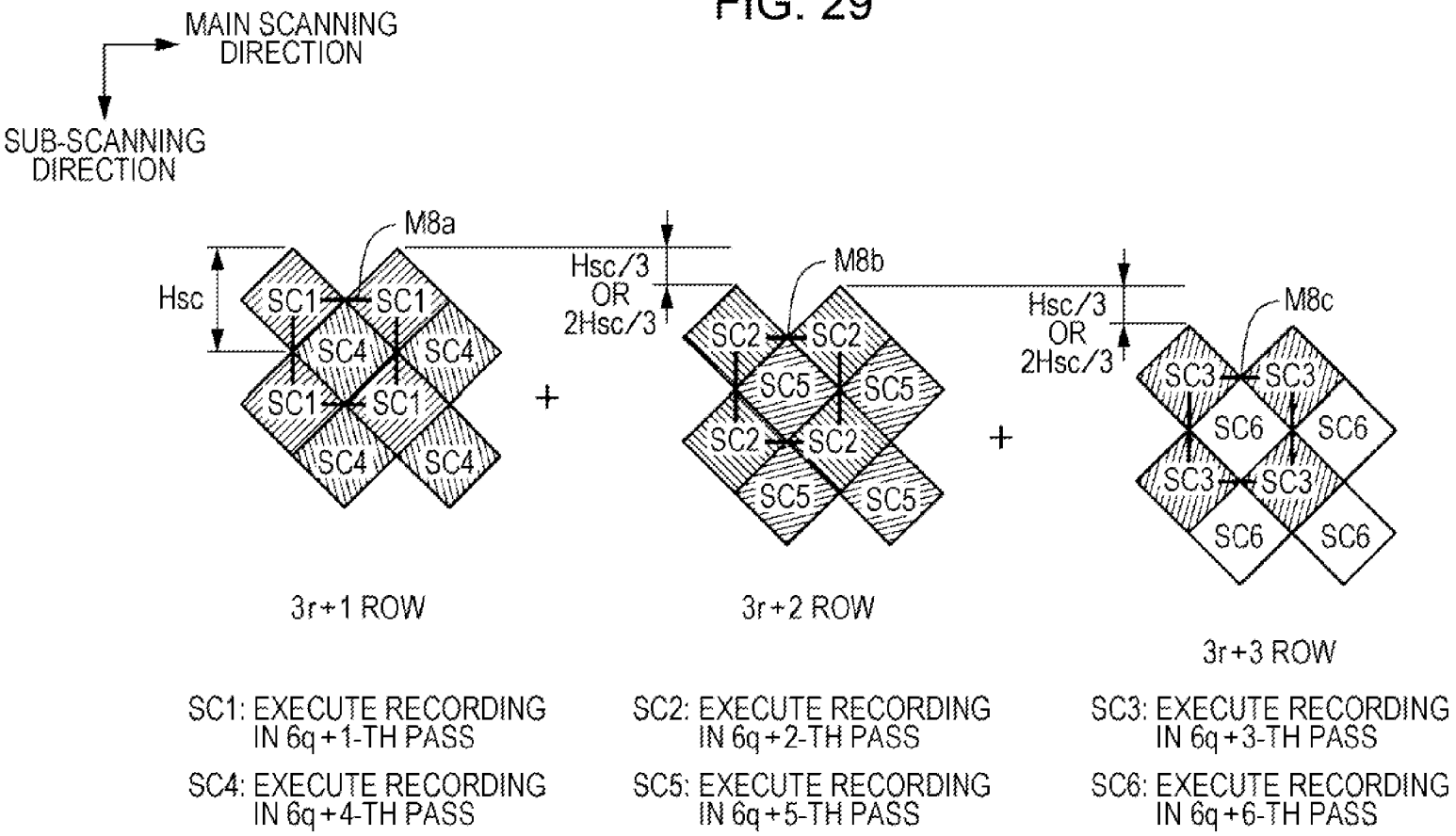
FIG. 29 is an explanatory diagram showing another embodiment in which there are six passes.

FIG. 29 is an explanatory diagram showing another embodiment in which there are six passes. In this embodiment, the pixel positions in which the dots are recorded are separated into the three rows of a 3r+1 row, a 3r+2 row and a 3r+3 row. The pixel positions of the 3r+1 row are recorded in the first and fourth passes, the 3r+2 row in the second and fifth passes, and the 3r+3 row in the third and sixth passes; thereby, the recording of the dots is performed in six passes. Each of the super cell regions SC1 to SC6 is arranged such that the boundary of the super cell regions SC1 and SC4, the boundary of the super cell regions SC2 and SC5 and the boundary of the super cell regions SC3 and SC6 do not overlap one another. Specifically, each of the super cell regions SC1 to SC6 is arranged such that the super cell regions SC1 and the super cell regions SC2 are shifted in the sub-scanning direction by ⅓ of the height Hsc of the super cell regions SC1, and the super cell regions SC2 and the super cell regions SC3 are shifted in the sub-scanning direction by ⅓ of the height Hsc of the super cell regions SC1. The amount of shifting in the sub-scanning direction may be ⅔ of the height Hsc of the super cell regions SC1. The other configuration matters of the sixth embodiment are the same as those of the fifth embodiment.

A configuration may be adopted in which the pixel positions of the 3r+1 row are recorded in the first and second passes, the pixel positions of the 3r+2 row are recorded in the third and fourth passes, and the 3r+3 row are recorded in the fifth and sixth passes. A configuration may be adopted in which the pixel positions of the 3r+1 row are recorded in the first and sixth passes, those of the 3r+2 row are recorded in the second and fifth passes, and those of the 3r+3 row are recorded in the third and fourth passes.

Figure 30:
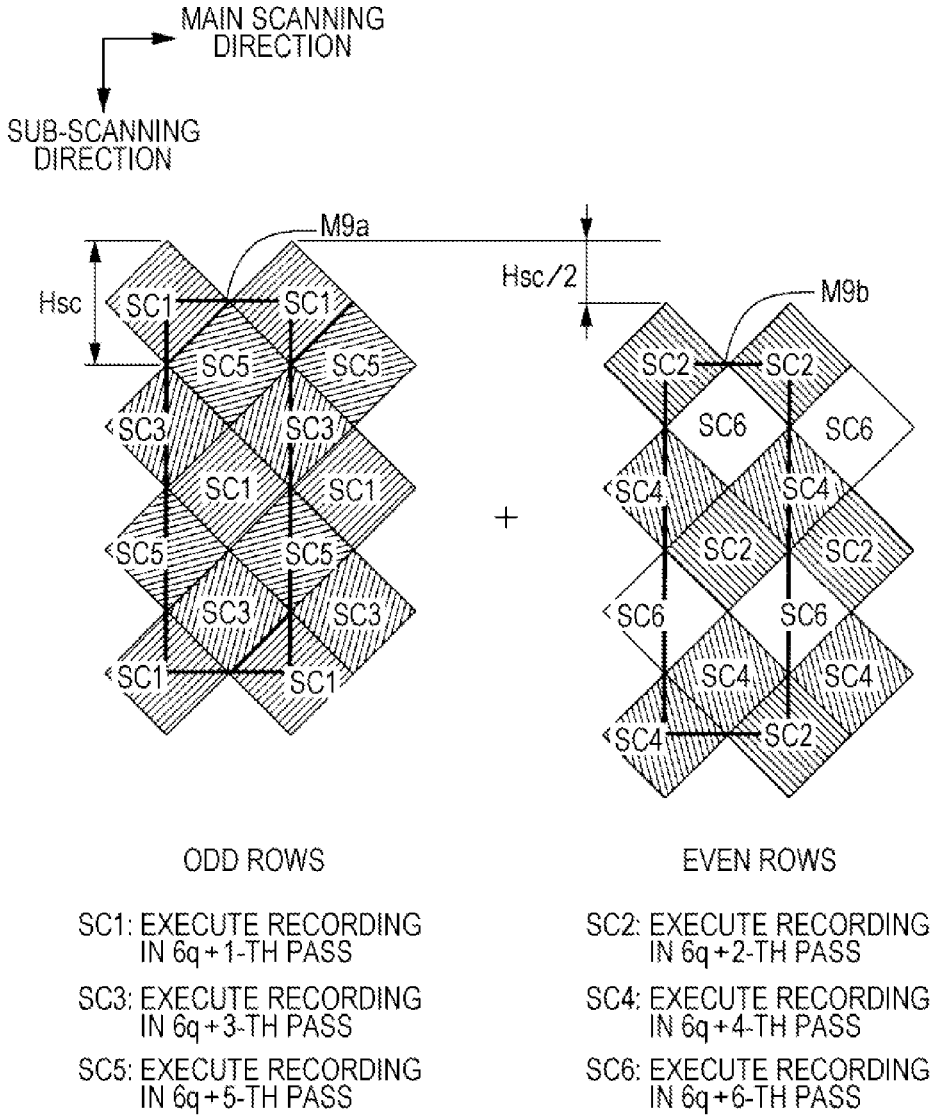
FIG. 30 is an explanatory diagram showing another embodiment in which there are six passes.

FIG. 30 is an explanatory diagram showing another embodiment in which there are six passes. In this embodiment, the pixel positions in which the dots are recorded are separated into odd rows and even rows. The dots are recorded on the pixel positions of the odd rows in the first, third and fifth passes, and the dots are recorded on the pixel positions of the even rows in the second, fourth and sixth passes. In the sub-scan that is performed after the individual passes, the nozzle row 95 moves by a distance of ⅓ of the head height Hh. The method of recording the dots in each of the odd rows and the even rows may be the same as that of the third embodiment shown in FIG. 15, for example. Each of the super cell regions SC1 to SC6 is arranged such that the super cell regions SC1 and the super cell regions SC3 are shifted in the sub-scanning direction by ½ of the height Hsc of the super cell regions SC1 such that the boundary of the super cell regions SC1, SC3 and SC5 and the boundary of the super cell regions SC2, SC4 and SC6 do not overlap one another. A configuration may be adopted in which the dots are recorded on the pixel positions of the odd rows in the first, second and third passes, and the dots are recorded on the pixel positions of the even rows in the fourth, fifth and sixth passes.

MODIFICATION EXAMPLE

The embodiments of the invention are described based on several embodiments. However, the embodiments of the inventions that are described above are simply for facilitating understanding of the invention and do not limit the invention. Naturally, the invention may be modified and improved within a range not exceeding the gist of the invention or the scope of the claims, and furthermore, the invention also includes equivalents thereto.

Modification Example 1

In the embodiments described above, the super cell regions have polygonal shapes; however, various shapes other than this may also be employed as the shape of the super cell regions; for example, an arabesque pattern shape or a fractal shape may be used.

Modification Example 2

In the embodiments described above, the number of passes n of the multi-pass recording is 2, 3, 4 or 6; however, it is possible to use an arbitrary integer of 2 or greater as the number of passes M. As long as the total dot proportion on each main scan line of each of the n main scan passes is set to 100%, it is possible to set the dot proportion in each of the main scan passes to an arbitrary value. It is preferable that the positions of the charged pixels in the n main scan passes do not overlap one another. Generally, it is preferable that the feed rate of the sub-scan that is performed after the completion of one of the main scan passes be set to a fixed value that is equivalent to 1/n of the head height.

Modification Example 3

In the embodiments described above, it is described that the recording head moves in the main scanning direction; however, the invention is not limited to the configuration described above as long as it is possible to cause the recording medium and the recording head to move relative to one another in the main scanning direction and to discharge the ink. For example, the recording medium may move in the main scanning direction while the recording head is in a stationary state, and the recording medium and the recording head may both move in the main scanning direction. It is sufficient for the recording medium and the recording head to also be capable of moving relative to one another in the sub-scanning direction. For example, a configuration may be adopted in which, as with a flatbed-type printer, recording is performed by a head portion moving in the X and Y directions in relation to the recording medium that is mounted (fixed) on a table. In other words, a configuration may be adopted in which it is possible to move the recording medium and the recording head relative to one another in at least one of the main scanning direction and the sub-scanning direction.

Modification Example 4

In the embodiments described above, description is given of a printing apparatus that discharges an ink onto printing paper; however, the invention can be applied to various other types of dot recording apparatuses. For example, the invention can also be applied to an apparatus that forms dots by discharging droplets onto a substrate. A liquid ejecting apparatus that ejects or discharges a liquid other than an ink may also be adopted, and the invention can be used in various types of liquid ejecting apparatuses that include a liquid ejecting head or the like that is caused to discharge a tiny amount of droplets. Furthermore, the term "droplets" refers to the state of the liquid that is discharged from the liquid ejecting apparatus, and includes liquids of a droplet shape, a tear shape, and liquid which forms a line-shaped tail. In addition, the term "liquid" referred to herein may be a material which can be ejected from the liquid ejecting apparatus. For example, the liquid may be a material which is in a liquid phase state, and includes liquid bodies of high or low viscosity, and fluid bodies such as sol, aqueous gel, other inorganic solvents, organic solvents, solutions, liquid resin, and liquid metal (molten metal). In addition, the liquid not only includes liquids as a state of a material, but also includes solutions, dispersions and mixtures in which particles of functional material formed from solids such as pigments and metal particulates are dissolved, dispersed or mixed into a solvent. Representative examples of the liquid include the ink described in the above embodiments or liquid crystal. Here, the term "ink" includes general aqueous inks and solvent inks, in addition to various liquid compositions such as gel ink and hot melt ink. A specific example of the liquid ejecting apparatus is a liquid ejecting apparatus which ejects a liquid which contains a material such as an electrode material or a color material in the form of a dispersion or a solution. The electrode material or the color material may be used in the manufacture and the like of liquid crystal displays, EL (electro-luminescence) displays, surface emission displays and color filters. The liquid ejecting apparatus may also be a liquid ejecting apparatus which ejects biological organic matter used in the manufacture of bio-chips, a liquid ejecting apparatus which is used as a precision pipette to eject a liquid to be a sample, a textile printing apparatus, a micro dispenser or the like. Furthermore, a liquid ejecting apparatus which ejects lubricant at pinpoint precision into precision machines such as clocks and cameras, a liquid ejecting apparatus which ejects a transparent resin liquid such as ultraviolet curing resin onto a substrate in order to form minute semispherical lenses (optical lenses) and the like used in optical communication devices and the like, or a liquid ejecting apparatus which ejects an acidic, or alkaline etching liquid or the like for etching a substrate or the like, may also be adopted as the liquid ejecting apparatus.

The entire disclosure of Japanese Patent Application No. 2013-147020, filed Jul. 12, 2013, is hereby expressly incorporated by reference herein.

What is claimed is:

1. A dot recording apparatus, comprising:

a recording head that includes a plurality of nozzles;

a main scan drive mechanism that executes a main scan pass for forming dots on a recording medium while causing the recording head and the recording medium to move relative to one another in a main scanning direction;

a sub-scan drive mechanism that executes a sub-scan for causing the recording medium and the recording head to move relative to one another in a sub-scanning direction that intersects the main scanning direction; and a control unit, wherein the control unit executes multi-pass recording in which recording of dots on a main scan line is completed in n (where n is a predetermined integer of 2 or greater) main scan passes, and executes the multi-pass recording for each of n types of super cell regions, that are each defined as regions that contain pixel positions in which recording of dots is performed in each main scan pass, and wherein the n types of super cell regions (i) include boundary portions that are not parallel to either the main scanning direction or the sub-scanning direction in boundaries of the individual super cell regions, and (ii) are arranged such that the boundary of the n types of super cell regions appears periodically repeating along both the main scanning direction and the sub-scanning direction.

2. The dot recording apparatus according to claim 1, wherein the super cell regions that are defined as regions in which an order of main scan passes in the multi-pass recording is represented by an ordinal number (n×q+k) that is calculated using a parameter k (where k is an integer that changes between 1 and n in a cyclic manner) and a parameter q (where q is an integer that increases by 1 at a time from 0), and wherein, when a plurality of main scan passes are classified into n types of main scan passes using n types of ordinal numbers (n×q+k) that correspond to different values of the parameter k, the regions contain pixel positions in which recording of dots is performed in each type of main scan pass of the n types of main scan passes.

3. The dot recording apparatus according to claim 1, wherein at least one of the super cell regions of the n types of super cell regions has a repeating pattern shape of a single polygonal shape.

4. The dot recording apparatus according to claim 1, wherein first super cell regions and second super cell regions of the n types of super cell regions overlap one another.

5. The dot recording apparatus according to claim 4, wherein, in an intermediate region in which the first super cell regions and the second super cell regions overlap one another, a dot recording charge rate, which is a ratio of the number of pixel positions at which dot recording is executed as pixel positions that belong to the first super cell regions to the number of pixel positions at which dot recording is executed as pixel positions that belong to the second super cell regions, is set to change as progress is made from the first super cell regions toward the second super cell regions.

6. The dot recording apparatus according to claim 1, wherein, when a boundary of one of the individual super cell regions contains a portion that is parallel to one of the main scanning direction and the sub-scanning direction, the parallel portion appears intermittently on the recording medium without continuing.

7. The dot recording apparatus according to claim 1, wherein a boundary of first super cell regions of the n types of super cell regions is shifted in the main scanning direction or the sub-scanning direction so as not to overlap the boundary of other super cell regions.

8. The dot recording apparatus according to claim 1, wherein the n types of super cell regions have different shapes from one another.

9. A dot recording method, comprising:

performing a main scan pass for forming dots on a recording medium while causing a recording head and a recording medium to move relative to one another in a main scanning direction;

performing multi-pass recording in which formation of dots on a main scan line is completed in n (where n is an integer of 2 or greater) main scan passes, and executing the multi-pass recording for each of n types of super cell regions, that are each defined as regions that contain pixel positions in which recording of dots is performed in each main scan pass, wherein the n types of super cell regions (i) include boundary portions that are not parallel to either the main scanning direction or the sub-scanning direction in boundaries of the individual super cell regions, and (ii) are arranged such that the boundary of the n types of super cell regions appears periodically repeating along both the main scanning direction and the sub-scanning direction.

10. A computer program product comprising one or more non-transitory, tangible computer-readable storage media that have thereon computer-executable instructions that, when executed by one or more processors, creates raster data for causing a dot recording apparatus to execute dot recording, wherein the dot recording apparatus performs a main scan pass for forming dots on a recording medium while causing a recording head and a recording medium to move relative to one another in a main scanning direction, and performs multi-pass recording in which recording of dots on a main scan line is completed in n (where n is a integer of 2 or greater) main scan passes, wherein the computer program has a function of causing a computer to create the raster data for causing the dot recording apparatus to execute the multi-pass recording for each of n types of super cell regions, that are each defined as regions that contain pixel positions in which recording of dots is performed in each main scan pass, based upon a mask the includes one complete super cell region of the n types of super cell region and a portion of another supper cell region of the n types of super cell region, and wherein the n types of super cell regions (i) include boundary portions that are not parallel to either the main scanning direction or the sub-scanning direction in boundaries of the individual super cell regions, and (ii) are arranged such that the boundary of the n types of super cell regions appears periodically repeating along both the main scanning direction and the sub-scanning direction.

* * * * *